US009920522B2

(12) United States Patent
Staten et al.

(10) Patent No.: US 9,920,522 B2
(45) Date of Patent: Mar. 20, 2018

(54) DEMOUNTABLE BARRIER SYSTEM

(71) Applicant: Rogers Athletic Company, Inc., Clare, MI (US)

(72) Inventors: Kenneth Edward Staten, Clare, MI (US); Zachary John Reger, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 342 days.

(21) Appl. No.: 14/462,661

(22) Filed: Aug. 19, 2014

(65) Prior Publication Data

US 2015/0047280 A1 Feb. 19, 2015

Related U.S. Application Data

(60) Provisional application No. 61/959,293, filed on Aug. 19, 2013.

(51) Int. Cl.

| | |
|---|---|
| ***E04B 2/74*** | (2006.01) |
| ***E04B 2/76*** | (2006.01) |
| ***E04B 2/78*** | (2006.01) |
| *E06B 1/36* | (2006.01) |
| *E06B 3/964* | (2006.01) |

(52) U.S. Cl.

CPC ..... *E04B 2/7455* (2013.01); *E04B 2/767* (2013.01); *E04B 2/7809* (2013.01); *E04B 2/7854* (2013.01); *E04B 2/7438* (2013.01); *E04B 2002/7461* (2013.01); *E04B 2002/7488* (2013.01); *E06B 1/363* (2013.01); *E06B 3/9642* (2013.01)

(58) Field of Classification Search

CPC .... E04B 2/7455; E04B 2/7854; E04B 2/7809; E04B 2/767; E04B 2002/7488; E04B 2/7438; E04B 2002/7461; E06B 3/9642; E06B 1/363

USPC ..... 52/281, 282.1, 282.3, 282.5, 762, 204.5, 52/204.53, 204.593, 238.1, 239, 241, 52/204.595, 741.4, 716.8

See application file for complete search history.

(56) References Cited

U.S. PATENT DOCUMENTS

| | | | | |
|---|---|---|---|---|
| 3,040,847 A | | 6/1962 | Webster | |
| 3,203,053 A | * | 8/1965 | Lane | E06B 3/26307 49/489.1 |
| 3,305,983 A | * | 2/1967 | Bus | E04B 2/82 52/111 |
| 3,339,324 A | * | 9/1967 | Stackhouse | 52/241 |
| 3,348,351 A | * | 10/1967 | Citarel | C08G 75/14 52/204.593 |
| 3,403,491 A | * | 10/1968 | Eichman | E04B 2/7881 52/204.591 |
| 3,436,881 A | * | 4/1969 | Schlecht | 52/91.3 |
| 3,447,824 A | * | 6/1969 | Brown | 52/281 |
| 3,453,789 A | * | 7/1969 | Stephenson | E04B 2/822 52/126.3 |

(Continued)

FOREIGN PATENT DOCUMENTS

| | | | | |
|---|---|---|---|---|
| WO | WO-91/12390 | * | 8/1991 | E04B 2/96 |

*Primary Examiner* — Brent W Herring

(74) *Attorney, Agent, or Firm* — Carlson, Gaskey & Olds, P.C.

(57) ABSTRACT

An exemplary demountable barrier system includes a panel, a frame structure having a channel to receive the panel, and a seal compressing against the panel to hold the panel. The seal is slideably attached to the frame structure.

26 Claims, 25 Drawing Sheets

(56) References Cited

U.S. PATENT DOCUMENTS 3,568,383 A 3/1971 Judkins et al.
3,579,939 A * 5/1971 Eichman ..... E04B 2/96 52/204.591
3,600,854 A * 8/1971 Dallaire et al. ..... 49/51
3,841,042 A 10/1974 Siegal
3,854,264 A * 12/1974 Thomassen ..... E04B 2/822 52/632
3,854,269 A * 12/1974 Hancock ..... 220/683
3,900,966 A * 8/1975 Suarez ..... 49/390
4,021,973 A 5/1977 Hegg et al.
4,117,640 A * 10/1978 Vanderstar ..... 52/204.593
4,205,498 A * 6/1980 Unayama ..... E04B 2/822 52/243.1
4,471,589 A * 9/1984 Schmidlin ..... 52/171.3
4,601,145 A * 7/1986 Wilcox ..... 52/238.1
4,619,092 A * 10/1986 Kaminaga ..... 52/235
4,638,614 A * 1/1987 Wilcox ..... 52/238.1
4,703,598 A 11/1987 Wilson et al.
4,750,305 A * 6/1988 Bastian ..... 52/127.11
4,805,365 A 2/1989 Bastian
4,821,476 A * 4/1989 Thoburn et al. ..... 52/238.1
4,852,317 A * 8/1989 Schiavello ..... E04B 2/7424 52/239
4,873,806 A * 10/1989 Jeschke ..... 52/235
5,036,637 A * 8/1991 Biebuyck ..... E04B 2/96 52/204.591
5,095,676 A * 3/1992 Muhle ..... E06B 3/5835 52/204.591
5,159,793 A * 11/1992 Deugo ..... E04B 2/7409 52/126.1
5,235,790 A * 8/1993 Ishikawa et al. ..... 52/235
5,307,597 A * 5/1994 Tanikawa ..... E06B 7/14 52/235
5,592,795 A * 1/1997 Rinehart et al. ..... 52/235
5,603,192 A * 2/1997 Dickson ..... E04B 2/827 52/235
5,603,585 A * 2/1997 Bruchu et al. ..... 403/382
5,617,682 A * 4/1997 Christopher ..... 52/200
5,647,179 A * 7/1997 Hayashi et al. ..... 52/235
5,746,032 A * 5/1998 Koike et al. ..... 52/204.1
5,875,596 A 3/1999 Muller
6,141,925 A * 11/2000 Halvorson, Jr. ..... E04B 2/7455 52/126.3
6,158,182 A * 12/2000 Biebuyck ..... 52/235
6,231,109 B1 * 5/2001 Beaver ..... B60J 3/023 248/229.26
6,327,826 B1 * 12/2001 Mann ..... 52/204.1
6,415,566 B2 * 7/2002 Auer ..... 52/238.1
6,578,340 B2 * 6/2003 Ishikawa et al. ..... 52/654.1
6,715,248 B2 * 4/2004 Biebuyck ..... 52/235
6,993,873 B2 * 2/2006 Biebuyck et al. ..... 52/235
7,138,166 B2 * 11/2006 Rinehart et al. ..... 428/99
7,389,617 B2 * 6/2008 Grunewald ..... 52/235
7,434,790 B1 * 10/2008 Hansen ..... 256/24
7,533,501 B2 * 5/2009 Neal ..... 52/204.54
7,941,982 B2 * 5/2011 Merica ..... 52/235
8,171,679 B2 * 5/2012 Brescia et al. ..... 52/173.3
8,341,903 B2 1/2013 Haab et al.
8,484,902 B1 * 7/2013 Brown et al. ..... 49/504
8,646,231 B2 * 2/2014 Eyme ..... 52/282.4
8,752,354 B2 * 6/2014 Honey ..... 52/656.5
8,844,219 B2 * 9/2014 Neal ..... E06B 5/106 52/204.57
2001/0004817 A1 * 6/2001 Auer ..... 52/238.1
2002/0124499 A1 * 9/2002 Braybrook ..... 52/235
2002/0195595 A1 * 12/2002 Shepherd ..... 256/25
2003/0131543 A1 * 7/2003 Hansort ..... E04G 21/26 52/127.2
2003/0200718 A1 * 10/2003 Ito ..... 52/716.5
2003/0221381 A1 * 12/2003 Ting ..... 52/204.1
2004/0182019 A1 * 9/2004 Flynn ..... E04F 21/1805 52/127.2
2008/0134597 A1 * 6/2008 Rinehart et al. ..... 52/204.62
2008/0295426 A1 12/2008 Milligan et al.
2009/0211190 A1 * 8/2009 Honey ..... 52/309.3
2009/0241466 A1 * 10/2009 Gussakovsky ..... 52/786.1

* cited by examiner

DEMOUNTABLE BARRIER SYSTEM

CROSS-REFERENCE TO RELATED APPLICATIONS

This application claims priority to U.S. Provisional Application No. 61/959,293, which was filed on 19 Aug. 2013 and is incorporated herein by reference.

BACKGROUND

Demountable barrier systems are used in many environments. Offices, hospitals, schools, etc. utilize demountable barrier systems to define spaces. Demountable barrier systems can be reconfigured to change a layout of interior and exterior spaces. Interior spaces of an office, for example, can be made bigger or smaller by reconfiguring the placement of demountable barrier systems. The demountable barrier systems are typically attached to more permanent building structures, such as the floors, ceilings, and walls of fixed construction.

Demountable barrier systems are different than fixed construction building systems. Reconfiguring spaces defined by fixed construction walls, for example, requires effectively destroying the fixed construction walls, and then building new fixed construction walls. Demountable barrier systems provide design flexibility and modularity as they can often be reconfigured without being effectively destroyed.

Fixed construction building systems can also have an undesirable appearance. In many fixed construction windows, for example, glazing beads are pressed into place after a windowpane is moved to an installed position. The glazing beads are exposed and provide an undesirable appearance. Demountable barrier systems can have a similar undesirable appearance.

SUMMARY

A demountable wall system according to an exemplary aspect of the present disclosure includes, among other things, a panel, a frame structure having a channel to receive the panel, and a seal compressing against the panel to hold the panel. The seal slideably attached to the frame structure.

In a further non-limiting embodiment of the foregoing demountable wall system, the seal is received within a groove provided in a wall of the channel.

In a further non-limiting embodiment of any of the foregoing demountable wall systems, the seal comprises a bulb.

In a further non-limiting embodiment of any of the foregoing demountable wall systems, all portions of the frame are spaced from the panel.

In a further non-limiting embodiment of any of the foregoing demountable wall systems, no portion of the frame contacts the panel.

In a further non-limiting embodiment of any of the foregoing demountable wall systems, a setting block is slideably received within the channel. The setting block supports the panel vertically.

In a further non-limiting embodiment of any of the foregoing demountable wall systems, the frame structure extends circumferentially about the panel, and the channel is circumferentially continuous about the panel.

In a further non-limiting embodiment of any of the foregoing demountable wall systems, the frame structure provides at least two channels, each of the at least two channels configured to receive a panel.

In a further non-limiting embodiment of any of the foregoing demountable wall systems, a clip secures a first member of the frame structure to a second member of the frame structure. The clip including a first tab received within one of the at least two channels and a second tab received within another of the at least two channels.

In a further non-limiting embodiment of any of the foregoing demountable wall systems, the clip includes a first finger secured to a first side of one of the at least two channels and a second finger secured to a second side of the another one of the at least two channels. The first side and the second side facing in opposite directions.

In a further non-limiting embodiment of any of the foregoing demountable wall systems, a cap is secured to the frame structure to cover the seal within the channel.

In a further non-limiting embodiment of any of the foregoing demountable wall systems, the cap is snap-fit to the frame structure.

In a further non-limiting embodiment of any of the foregoing demountable wall systems, the frame structure is a first frame structure secured to a fixed surface of an angled interface member, and a second frame structure is secured to an adjustable surface is secured to a rounded portion of the angled interface member. The first frame structure at least partially supports the panel to provide a first wall, and the second frame structure at least partially supports another panel to provide a second wall that is angled relative to the first wall.

In a further non-limiting embodiment of any of the foregoing demountable wall systems, a keying feature aligns the adjustable surface relative to the rounded portion when the adjustable surface is secured to the rounded portion.

In a further non-limiting embodiment of any of the foregoing demountable wall systems, the keying feature comprises a groove in one of the adjustable surface or the rounded portion, and a tab in the other one of adjustable surface or the rounded portion.

In a further non-limiting embodiment of any of the foregoing demountable wall systems, another keying feature aligns the first frame structure to the fixed surface when the first frame structure is secured to the fixed surface.

A method of installing a panel of a demountable wall according to an exemplary aspect of the present disclosure includes, among other things, inserting a panel into a channel of a frame structure, and holding the panel using a seal that is slideably secured to the channel.

In a further non-limiting embodiment of the foregoing method, the method further comprises compressing the seal against a first side of the panel during the holding and compressing another seal against an opposite, second side of the panel during the holding.

In a further non-limiting embodiment of the foregoing method, the method comprises covering the seal within channel with a cover that is removeably attached to the frame structure.

In a further non-limiting embodiment of the foregoing method, no portion of the frame structure contacts the panel during the holding.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
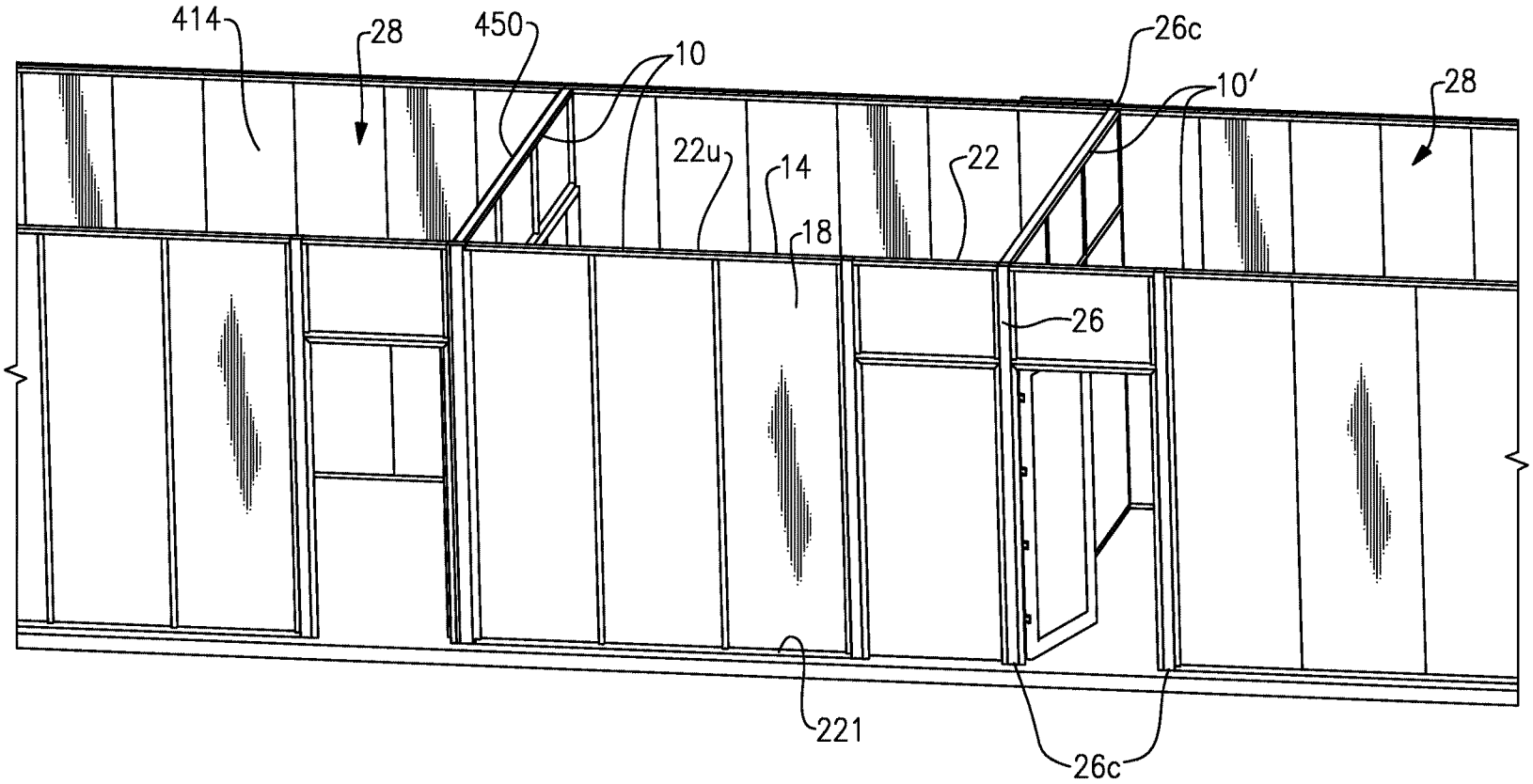
FIG. 1 shows a perspective front view of interior spaces that are at least partially defined by a demountable barrier system.

Referring to FIGS. 1-8, an example demountable barrier system 10 includes a frame structure 14 holding a plurality of panels 18. The frame structure 14 includes horizontal members 22 and vertical members 26.

In this example, lower horizontal members 221 can attach to a floor of a building, upper horizontal members 22*u* can attach to a ceiling of the building, and the vertical members 26 can attach to exterior walls of a building. Also, the lower horizontal members 221, the upper horizontal members 22*u*, and the vertical members 26 can attach to another demountable barrier system 10'.

The demountable barrier systems 10 and 10' together define a plurality of interior spaces 28. In other examples, the demountable barrier system 10 is used without the demountable barrier system 10' to define the interior spaces 28. The demountable barrier systems 10 and 10' generally define demountable walls in this example. In other examples, the demountable barrier systems 10 and 10' define floors, ceilings, partial walls, etc.

The frame structure 14 is secured, in this example, to the other demountable barrier system 10' and relatively permanent structures, such as the walls, ceilings, and floors, of the building. In other examples, the frame structure 14 is free standing and placed on the floor (or ground if the frame structure 14 is used outside a building). In other examples, the frame structure 14 is not used in connection with the other demountable barrier system 10'.

The panels 18 are held within channels 38 of the horizontal members 22 and the vertical members 26. The frame structures 14 and panels 18, when assembled, establish the various interior spaces 28.

The frame structure 14 can be configured and reconfigured to adjust the size and position of the interior spaces 28. The types of panels 18 held within the frame structure 14 can be selected and placed within the frame structure 14 to further customize and configure the interior spaces 28.

In this example, some of the horizontal members 22 and some of the vertical members 26 define three channels 38. The example channels 38 include an interior channel 38*i* and two outer channels 380. The interior channel 38*i* is between the outer channels 38*o* such that the outer channels 38*o* are laterally outside the channel 38*i*. The channels 38 selectively receive the panels 18 to establish the dividers or walls that partially define the interior spaces 28.

Although described in this example as having three channels 38, the demountable barrier system 10 may include less than three or more than three channels 38. For example, another demountable barrier system 10 may include four or five channels.

Some portions of the frame structure 14 do not define channels. These portions may instead provide support at interfaces and near doors, for example. The portions of the frame structure 14 that do not provide channels 38 include in this examples column-type vertical members 26*c*.

Figure 3:
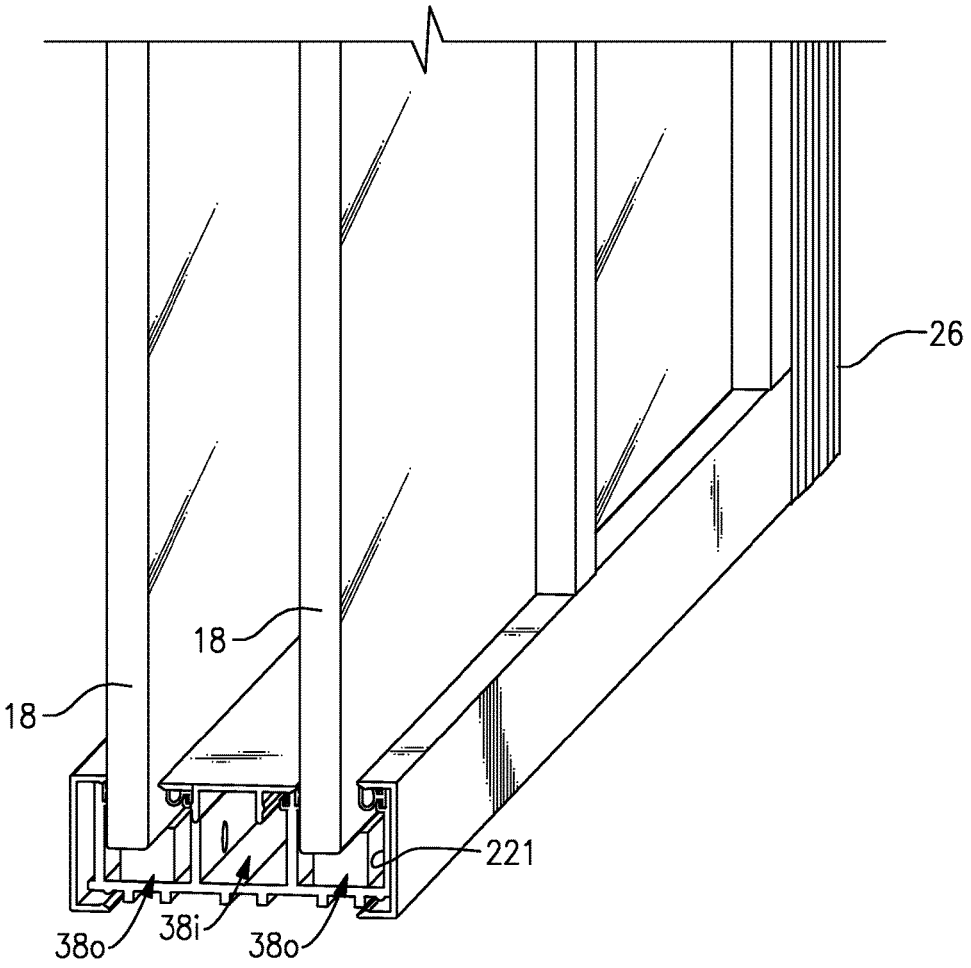
FIG. 3 shows a section view of a portion of the demountable barrier system of FIG. 1 in a first configuration with two panels in laterally outer channels of a frame structure.
Figure 4:
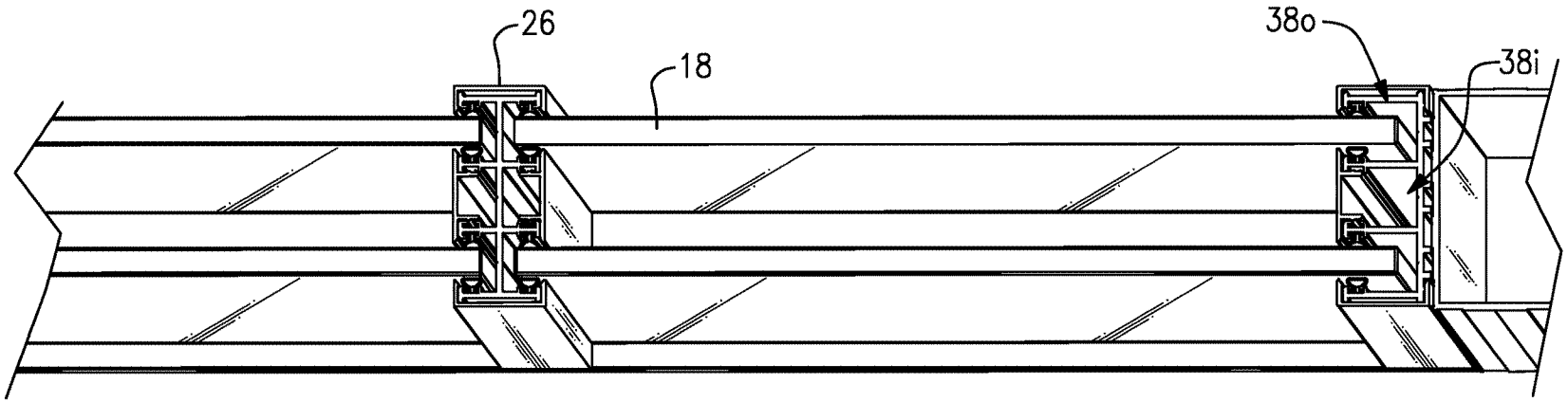
FIG. 4 shows another section view of the portion of FIG. 3.

In the configuration of FIGS. 3 and 4, the outer channels 38*o* each receive one of the panels 18, and the interior channel 38*i* does not receive one of the panels 18. In such an example, a two-paneled wall divider is provided.

Figure 5:
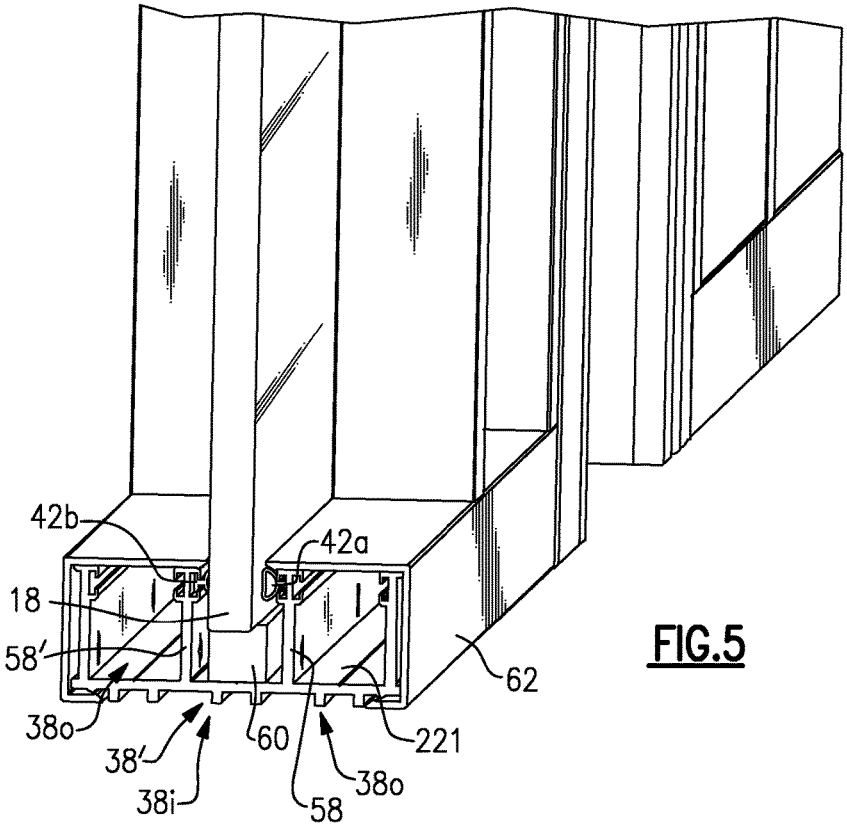
FIG. 5 shows a section view of the demountable barrier system of FIG. 1 in a second configuration with one panel in an interior channel between the laterally outer channels of the frame structure.
Figure 5A:
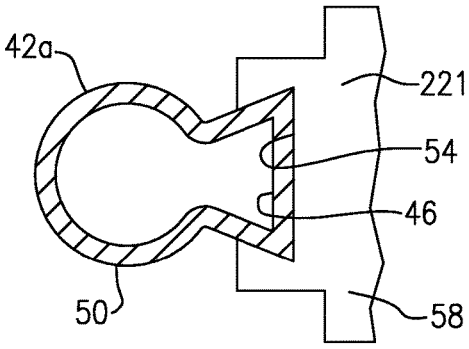
FIG. 5A shows a seal of the demountable barrier system of FIG. 1 prior to installing a panel.
Figure 6:
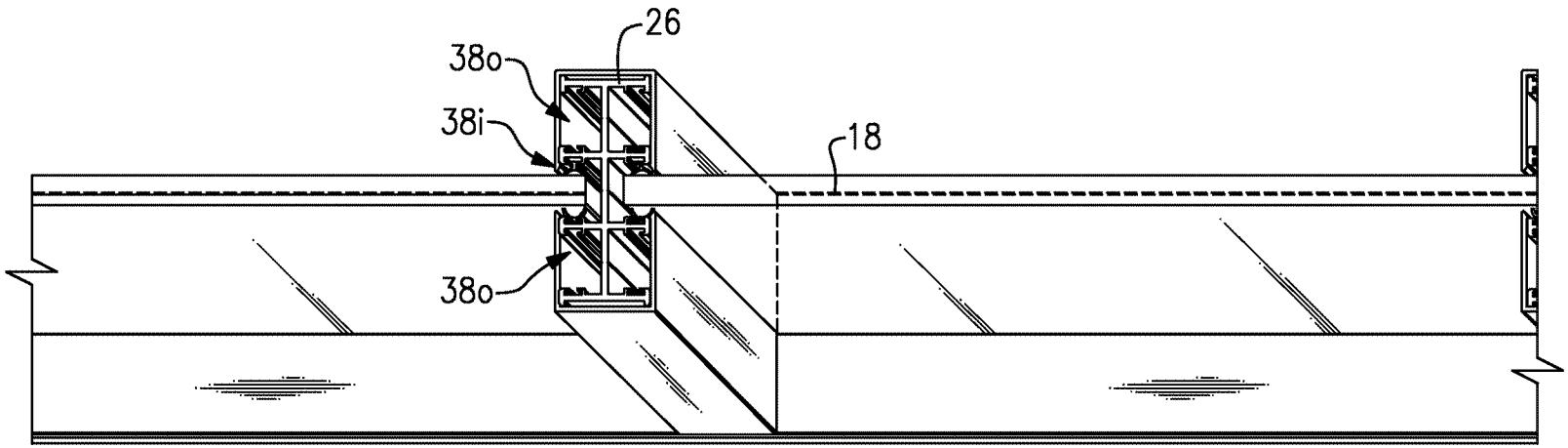
FIG. 6 shows another sectional view of the portion of FIG. 5.

In the configuration of FIGS. 5 and 6, the interior channel 38*i* receives one of the panels 18 and the outer channels 38*o* does not receive any of the panels 18. In such an example, a single-paneled wall divider is provided.

Figure 7:
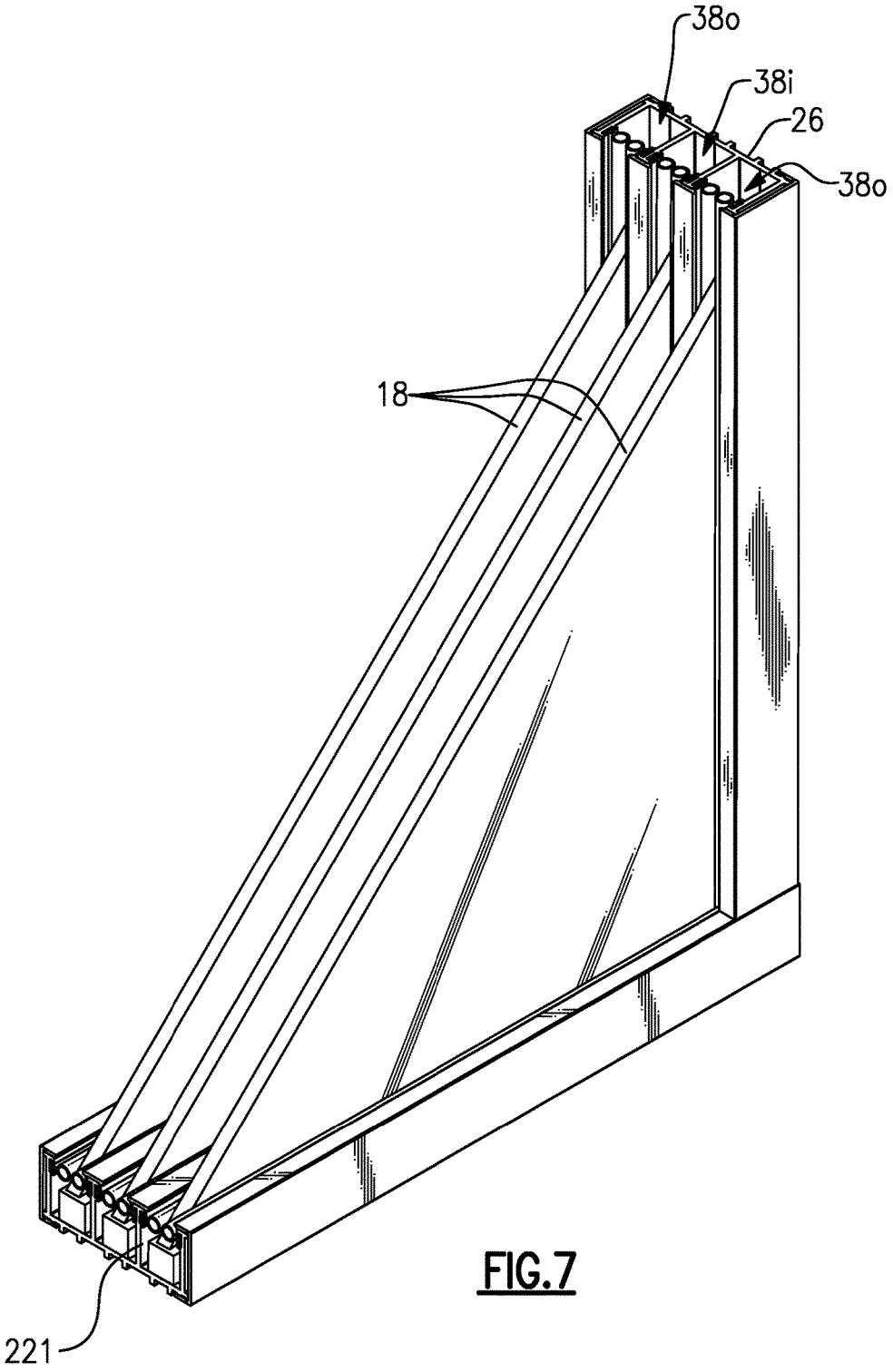
FIG. 7 shows various sectional views of the demountable barrier system of FIG. 1 in a third configuration having three panels, one in each of the laterally outer channels and the inner channel of the frame structure.
Figure 8:
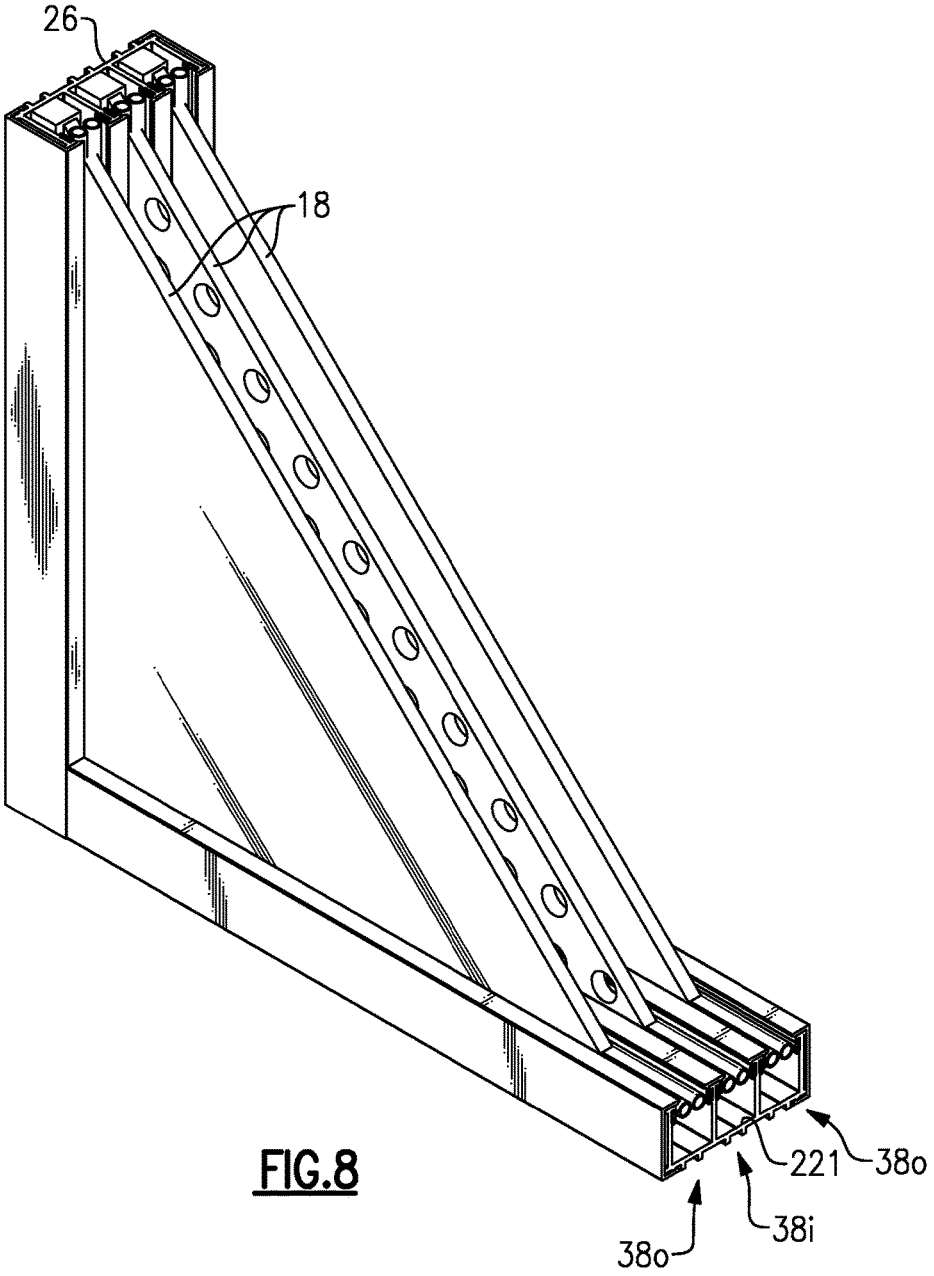
FIG. 8 shows another sectional view of the third configuration of FIG. 7 with an alternative decorative panel in the inner channel.
Figure 9:
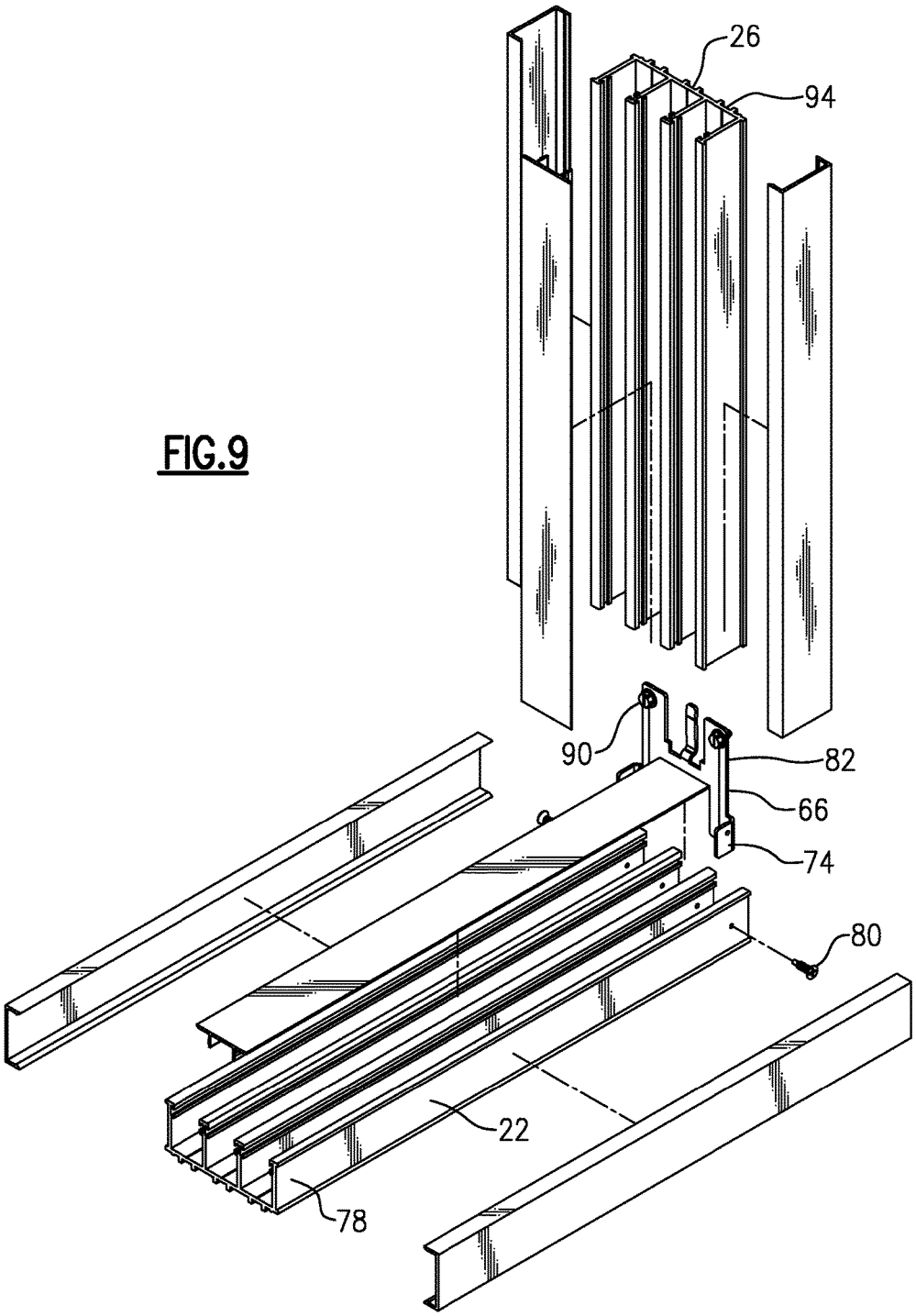
FIG. 9 shows an exploded view of a portion of an end interface of the frame structure in the first configuration.
Figure 10:
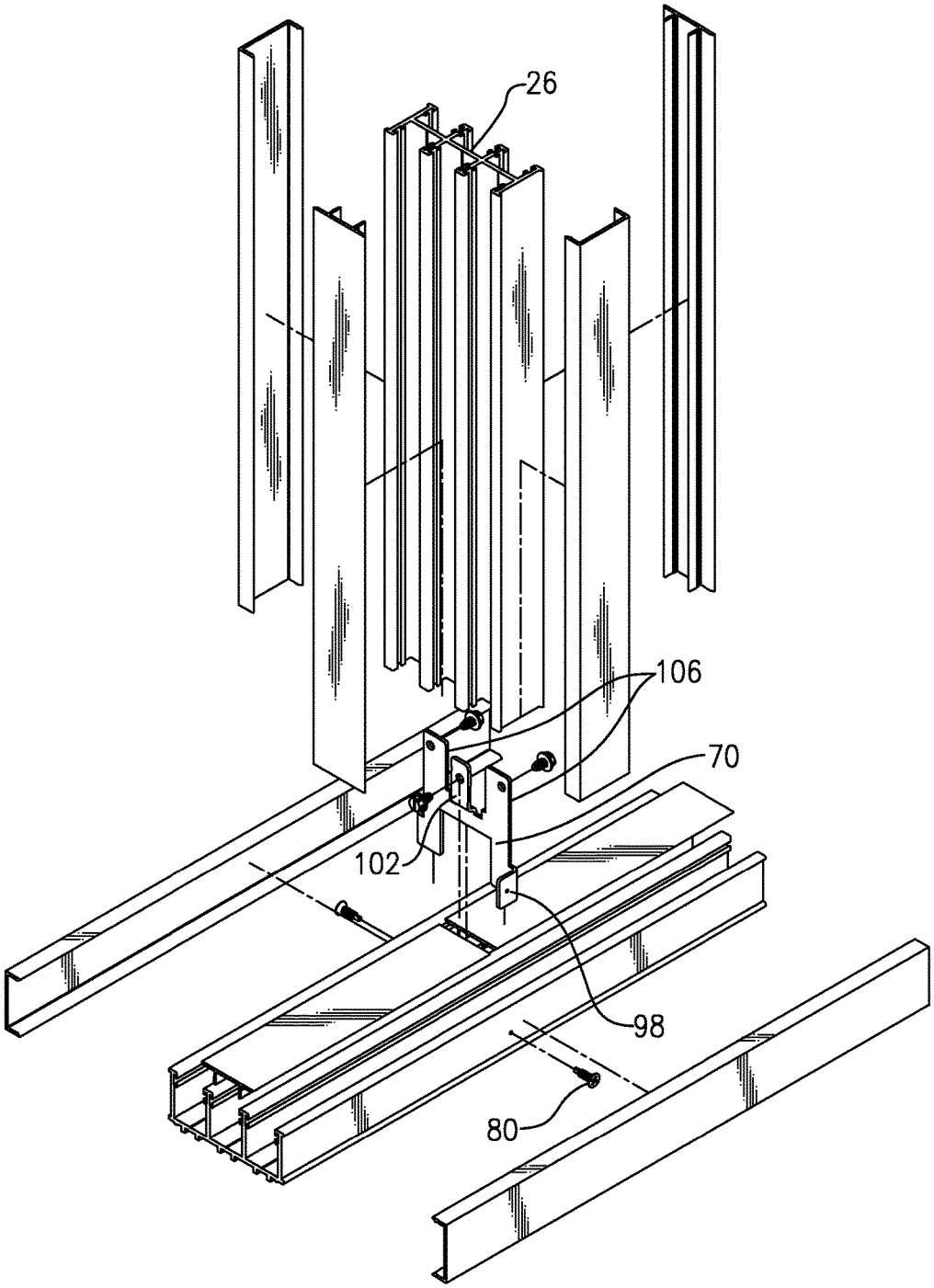
FIG. 10 shows an exploded view of a portion of an inner interface of the frame structure in the first configuration.
Figure 11:
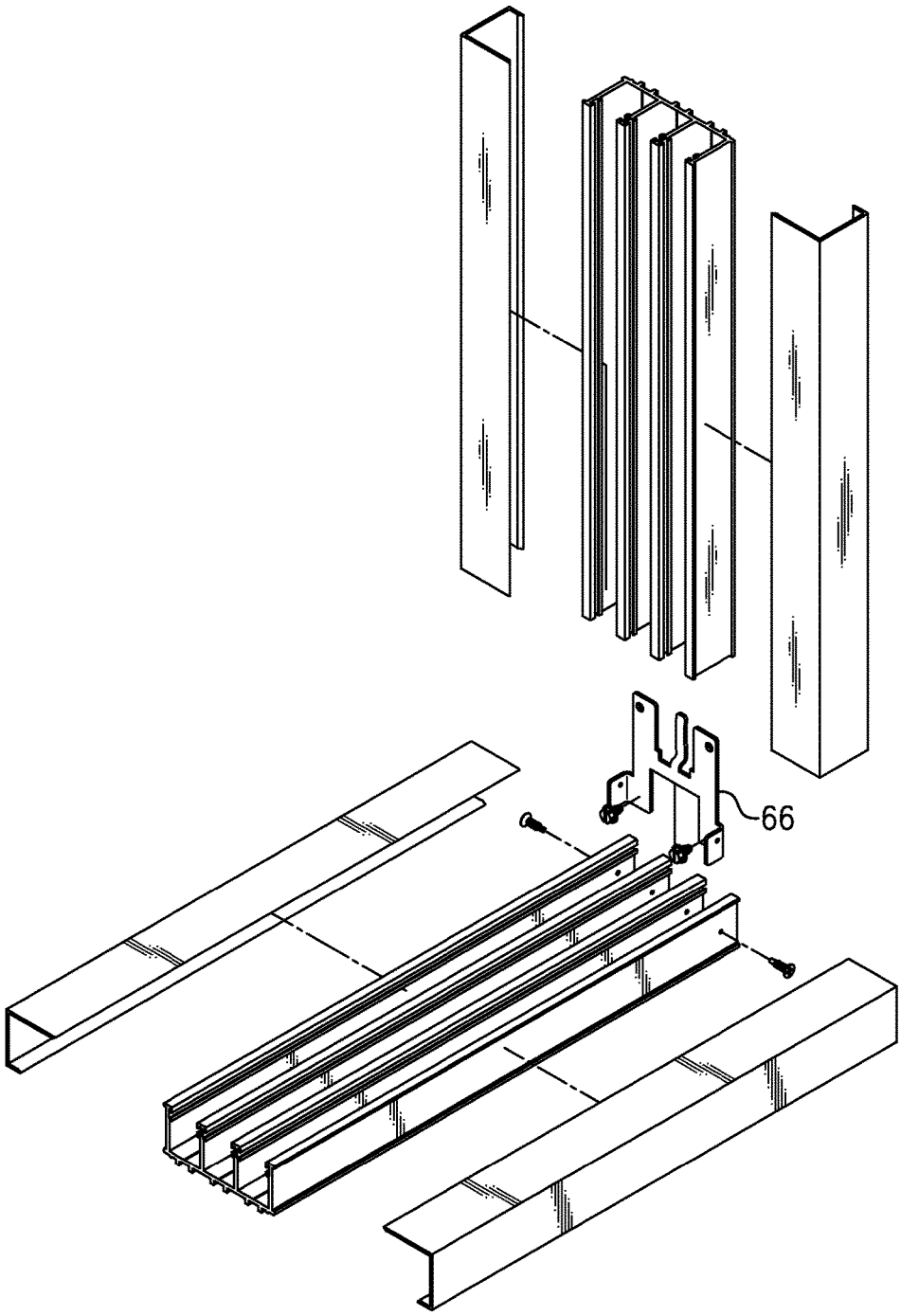
FIG. 11 shows an exploded view of a portion of an end interface of the frame structure in the second configuration.

In the configuration of FIGS. 7 and 8, the interior channel 38*i* receives one of the panels 18 and the outer channels 38*o* each also receive one of the panels 18. In such an example, a tri-paneled wall divider is provided. This particular design can have low sound transmission depending on the panels 18.

Various types of panels 18 may be used in the configurations of FIGS. 1-8 to provide a desired demountable barrier. The panels 18 may be glass, wood, composite, etc. In the configuration of FIG. 8, the panels 18 in the outer channels 38*o* provide a view of a decorative panel in the interior channel 38*i*. The decorative panel may display a company logo or some design. The panels 18 in the outer channels 38*o* protect the decorative panel from dust and dirt accumulation. If glass panels are used, the glass may be glazed.

In any of the configurations, lighting could be positioned within the channels 38 to illuminate the panels 18 or some other area. Cabling could also be routed within the channels 38.

To assemble the demountable barrier system 10, the frame structure 14 is assembled, at least partially, and then the panels 18 are inserted into the desired channels 38. The frame structure 14 is assembled by securing the horizontal members 22 and vertical members 26 to each other and, optionally, the ceiling, the floor, and the relatively permanent structures of a building. Mechanical fasteners, such as bolts and nuts, secure the frame structure 14 together in some examples. Plates, as will be explained, also may be used.

In some examples, the upper horizontal members 22*u* are secured to the splines of a dropped ceiling structure with clips. The splines support dropped ceiling tiles. The splines hang from a main structural ceiling of a building.

In some examples, the lower horizontal members 221 are secured to a carpeted floor of a building using set screws.

Figure 5B:
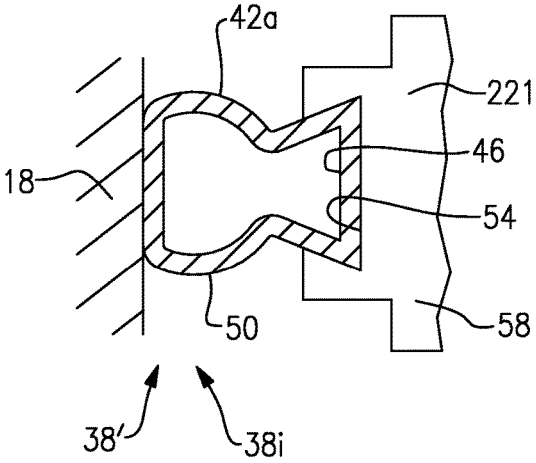
FIG. 5B shows the seal of FIG. 5A after installing the panel.

With specific reference to FIGS. 5-5B, installation of one of the panels 18 will be described. The panel 18 of this example is received within the channel 38'. When the panel 18 is installed, the channel 38' extends about the entire perimeter of the panel 18. That is, all four sides of the panel 18 are received within the channel 38'. Portions of the channel 38' are provided by one of the horizontal members 221', one of the horizontal members 22*u*, and two of the vertical members 26.

During assembly, a first seal structure 42*a* is inserted into the channel 38' that will receive the panel 18. The first seal structure 42*a* may be inserted prior to, or after, assembling the horizontal members 22 and vertical members 26.

The first seal structure 42*a* includes a base 46 and a bulb 50. To install the first seal structure 42*a*, the base 46 is slid within a groove 54 provided in a wall 58 of the channel 38'.

A second seal structure 42*b* is then installed on an opposing side of the channel 38'. The second seal structure 42*b* is constructed similarly to the first seal structure 42*a*. The base of the second seal structure 42*b* is slid within the groove 54' provided in a wall 58' of the channel 38 opposite the wall 58.

The panel 18 is then placed within at least some of the channel 38'. One or more of the horizontal members 22 or vertical members 26 may be moved to facilitate placement of the panel 18 within the channel 38'. For example, mechanical fasteners holding the frame 14 may be loosened to allow one of the vertical members 26 to slide or adjust a sufficient amount to allow for positioning the panel 18 within the channel 38.' After positioning the panel 18, that vertical member 26 is moved to a position appropriate for holding the panel 18 and reattached to the frame structure 14.

The panel 18 may be positioned on a setting block 60 that is placed within the portion of the channel 38' defined by the lower horizontal member 221. The panel 18 rests on the setting block 60 to vertically position the panel 18. The setting block 60, in some examples, has a rectangular cross-section and is made of a hard rubber material.

During installation of the panel 18, force applied to the panel 18 may compress the seal structures 42*a* and 42*b* toward the respective wall 58 or 58'. After removing the seal-compressing forces from the panel 18, the seal structures 42*a* and 42*b* expand away from the respective wall 58 or 58' against the panel 18. The first and second seal structures 42*a* and 42*b* sandwich the panel 18 to hold the panel 18 with the channel 38.

As the seal structures 42*a* and 42*b* contact the panel 18 and the wall 58 or 58, the seal structures 42*a* and 42*b* effectively close gaps between walls 58 of the channels 38 and the panels 18. Closing these gaps prevents dirt, dust, and other undesired material from entering the channels 38 holding the panels 18.

In this example, the seal structures 42*a* and 42*b* on both sides of the panel 18 are installed prior to placing the panel 18 within the channel 38. In another example, one or both of the seal structures 42*a* and 42*b* is installed after placing the panel 18 within the channel.

After positioning the seal structures 42*a* and 42*b*, laterally outer covers or caps 62*o* are secured to the laterally outboard sides of the horizontal members 22 and the vertical members 26. The caps 62*o* snap onto the horizontal members in this example.

The outer caps 62*o* hide most or all of the seal structures 42*a* and 42*b* from view. The outer caps 62*o* also hide portions of the frame structure 14 to provide an aesthetically pleasing appearance.

Although described with reference to the channel 38' and panel of FIGS. 5-5B, the other panels 18 of the demountable barrier system 10 are similarly installed. Notably, if a panel 18 is not received within the interior channel 38*i*, such as in the embodiments of FIGS. 3-4, an interior cap 62*i* may be used. Also, the outer caps 62*o* may be sized differently if panels 18 are placed in the channels 38*o*.

The caps 62*o* and 62*i* do not directly contact the panels 18 in this example. The caps 62*o* and 62*i* may be spaced ⅜" away from the panels 18. In other examples, the caps 62*o* and 62*i* do contact the panels 18. The caps 62*o* and 62*i* may contact the panels 18 if the panels 18 is wood or composite.

The caps 62*o* and 62*i* may be powder coated or anodized in some examples.

Referring now to FIGS. 9-13 with continuing reference to FIGS. 1-8, the horizontal members 22 and vertical members 26 of the frame structure 14 are assembled, in this example, utilizing clips 66 and 70. The clips 66 secure end interfaces of the frame structure 14. The clips 70 secure inner interfaces of the frame structure 14.

The clip 66 includes tabs 74 that are secured to the outermost walls 78 of the horizontal member 22. The example tabs 74 both extend horizontally in the same direction enabling the clip 66 to be positioned close to an end of the horizontal member 22 without extending past the end of the horizontal member 22.

Figure 12:
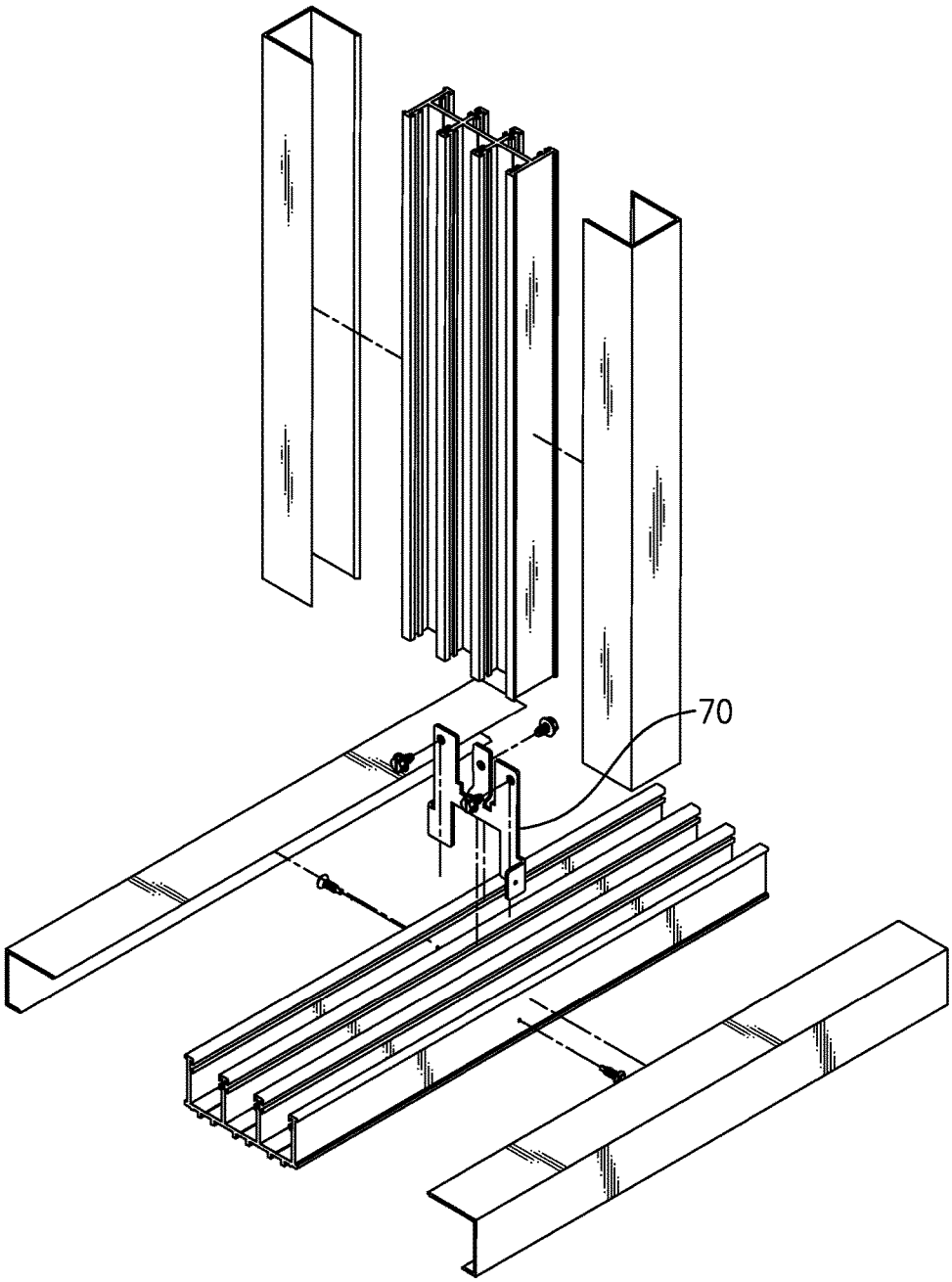
FIG. 12 shows an exploded view of a portion of an inner interface of the frame structure in the second configuration.
Figure 13:
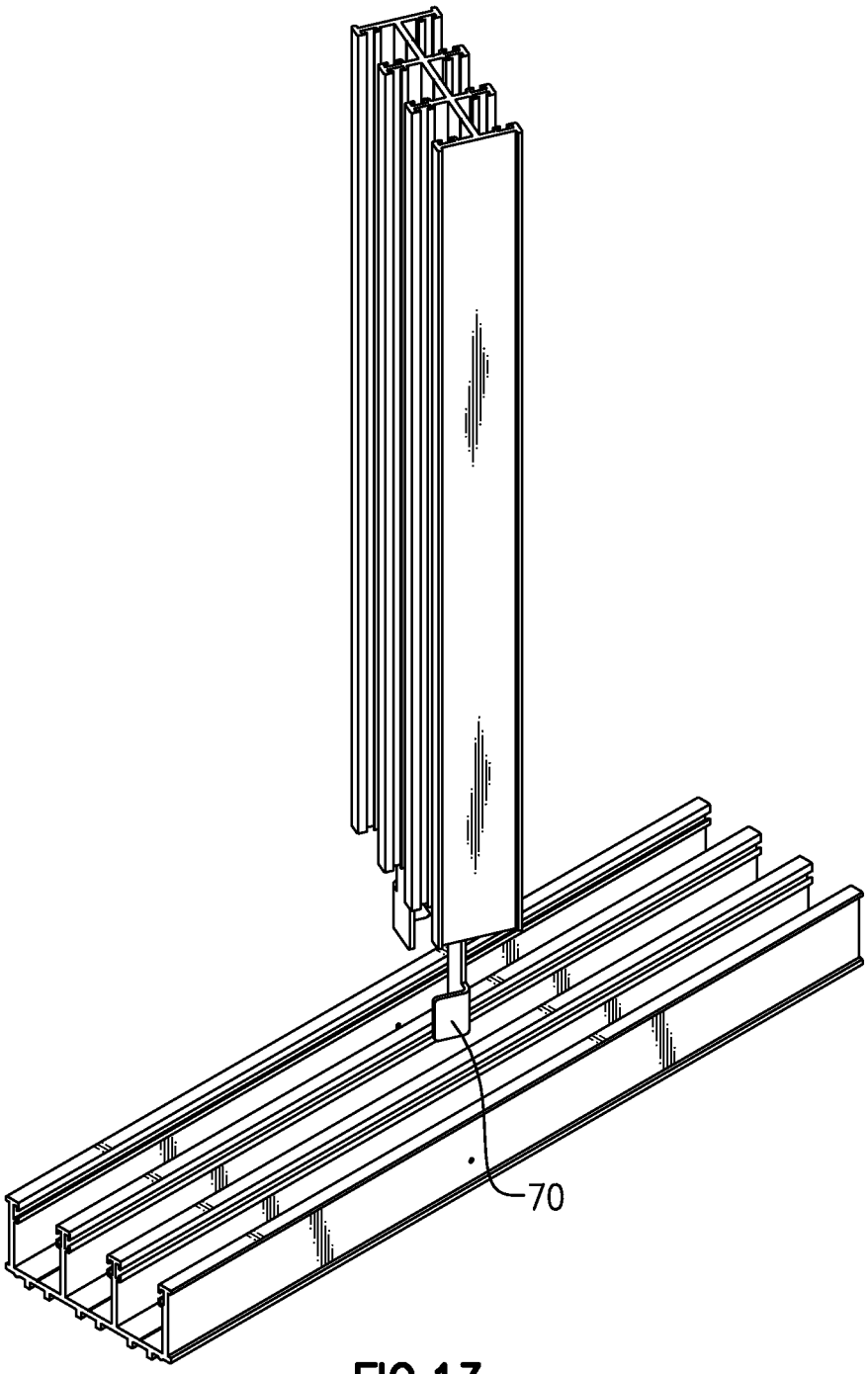
FIG. 13 shows selected views of an installation of an inner interface of the frame structure.

The clip 70 includes tabs 98 that are secured to the outermost walls 78 of the horizontal member 22. The example tabs 98 of the clip 70 extend horizontally in opposite directions to stabilize the clip 70 within the channels 38 of the horizontal member 22. Mechanical fasteners 80 secure the tabs 74 and 98 to the outermost walls 78. The clip 70 may be twisted into an installed position as shown in FIG. 12.

The clip 66 includes fingers 82 that fit within channels 38 of the vertical member 26. Mechanical fasteners 90 secure the fingers 88 to a floor 94 of the vertical member 26. The clip 70 includes fingers 102, which are similar to the fingers 82. The clip 70 also includes fingers 106 positioned between the fingers 102. The fingers 102 and 106 are secured to opposite sides of the floor 94.

The vertical member 26 interfacing with the clip 66 includes channels 38 only on one side, which allows the vertical member 26 utilized with the clip 66 to be placed directly against a permanent wall structure or the other demountable barrier system 10'. The vertical member 26 interfacing with the clip 70 includes channels 38 on opposing sides. The vertical member 26 would be used within a middle section of the frame structure 14 and would have panels 18 on opposing sides.

Figure 14:
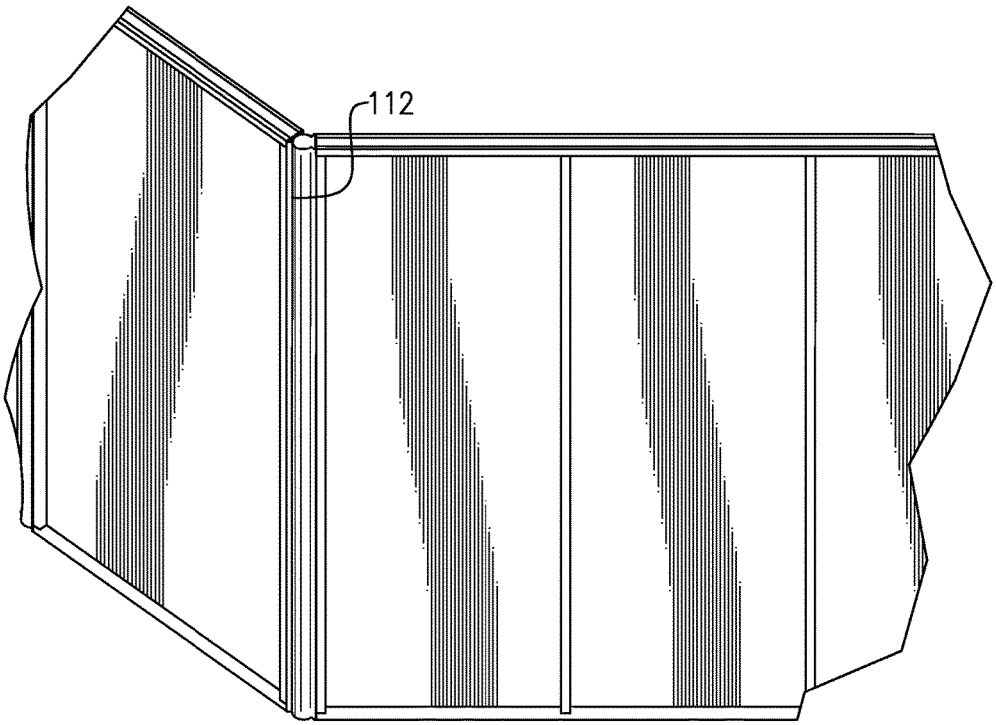
FIG. 14 shows a perspective view of an angled end interface of the demountable barrier system.
Figure 15:
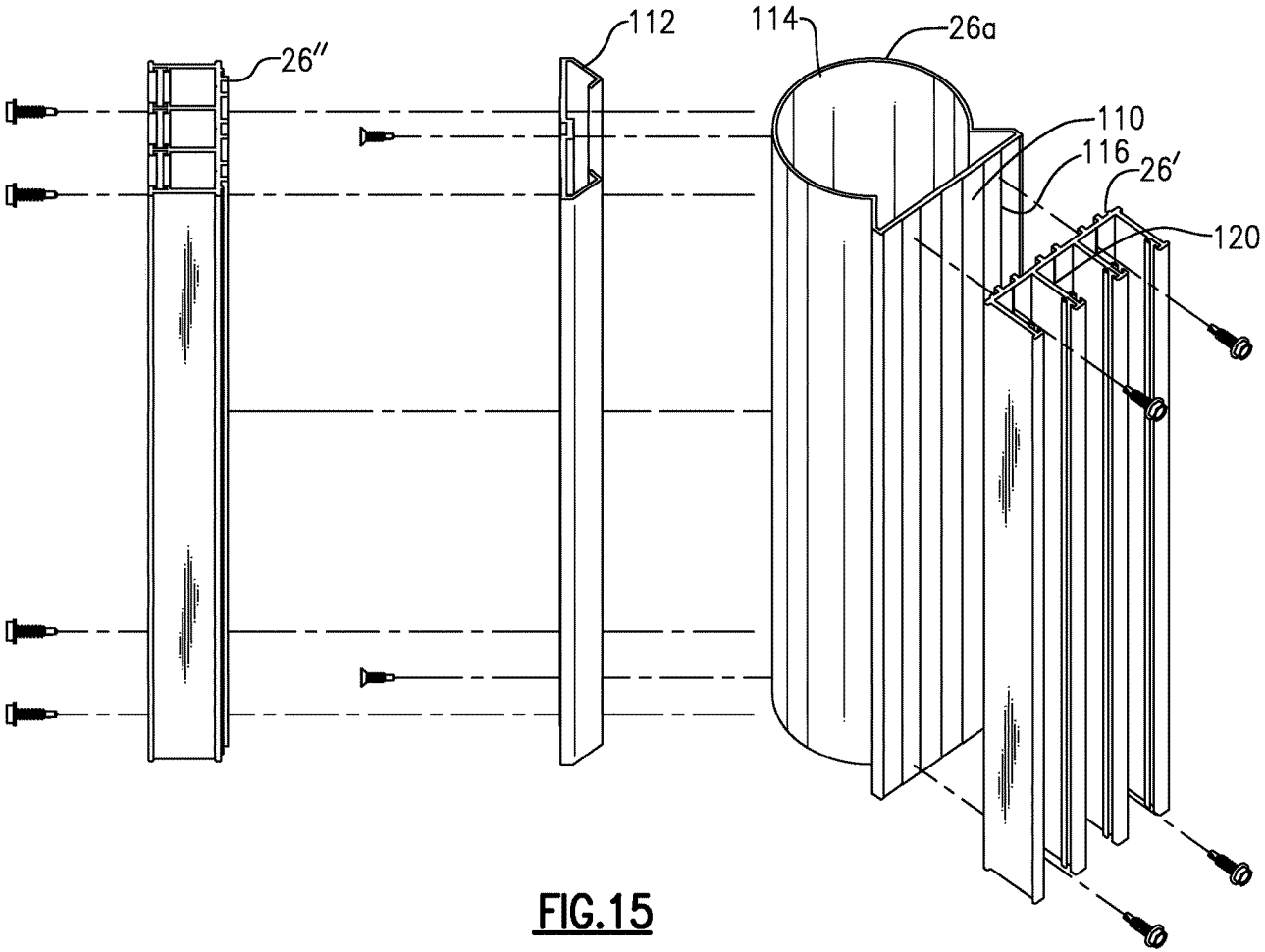
FIG. 15 shows an exploded view of an angled end interface of the frame structure.
Figure 16:
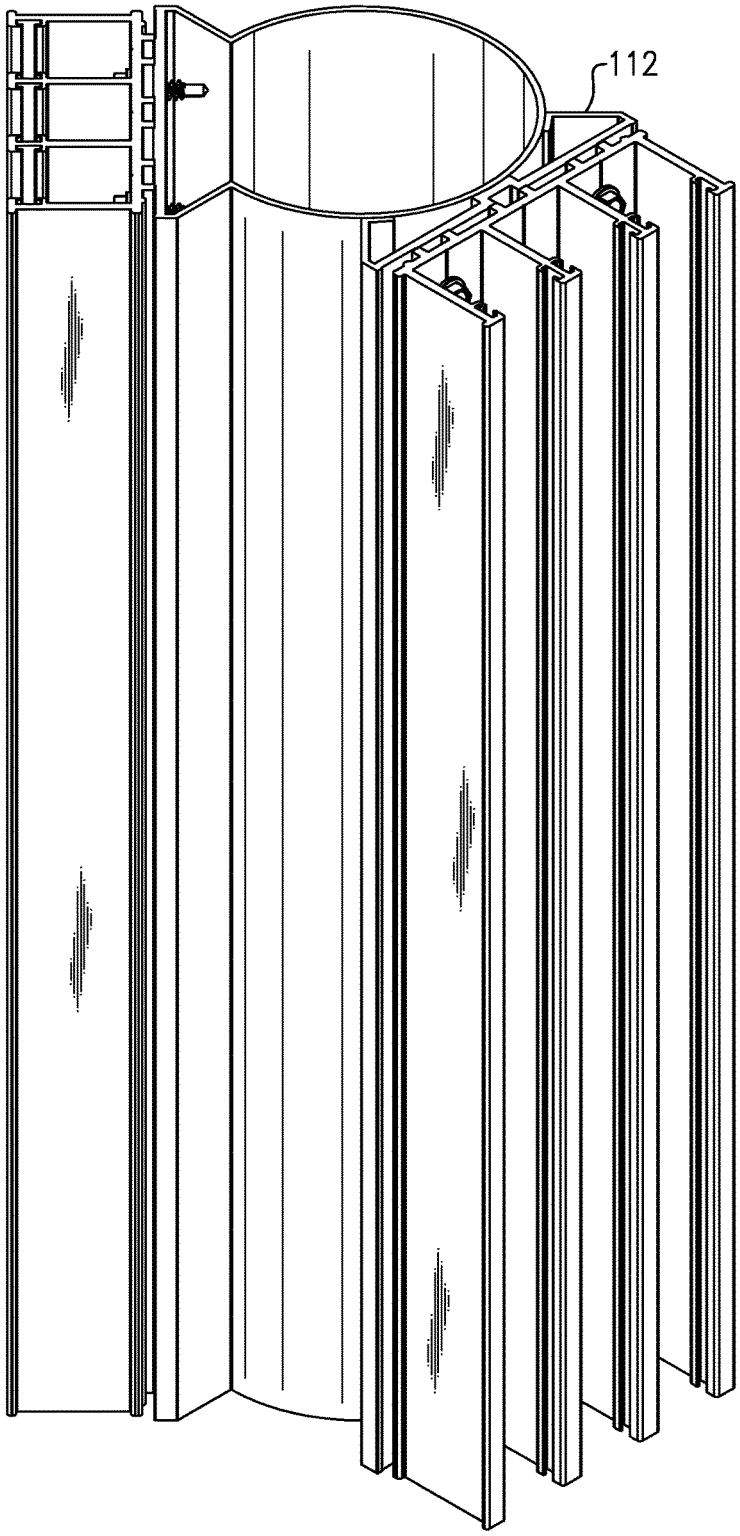
FIG. 16 shows a perspective view of the angled end interface of FIG. 14.
Figure 17:
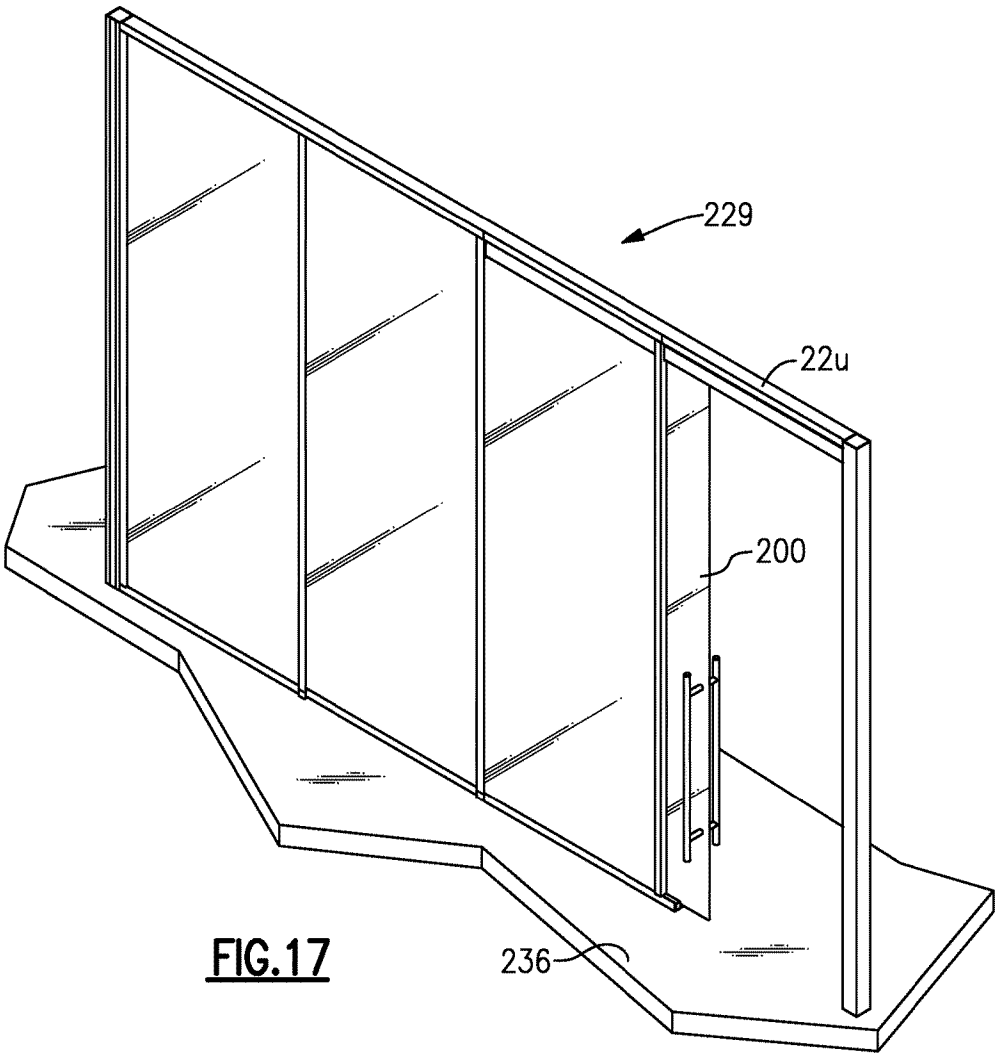
FIG. 17 shows a perspective view of a pocket door assembly for use in the demountable barrier system of FIG. 1.
Figure 18:
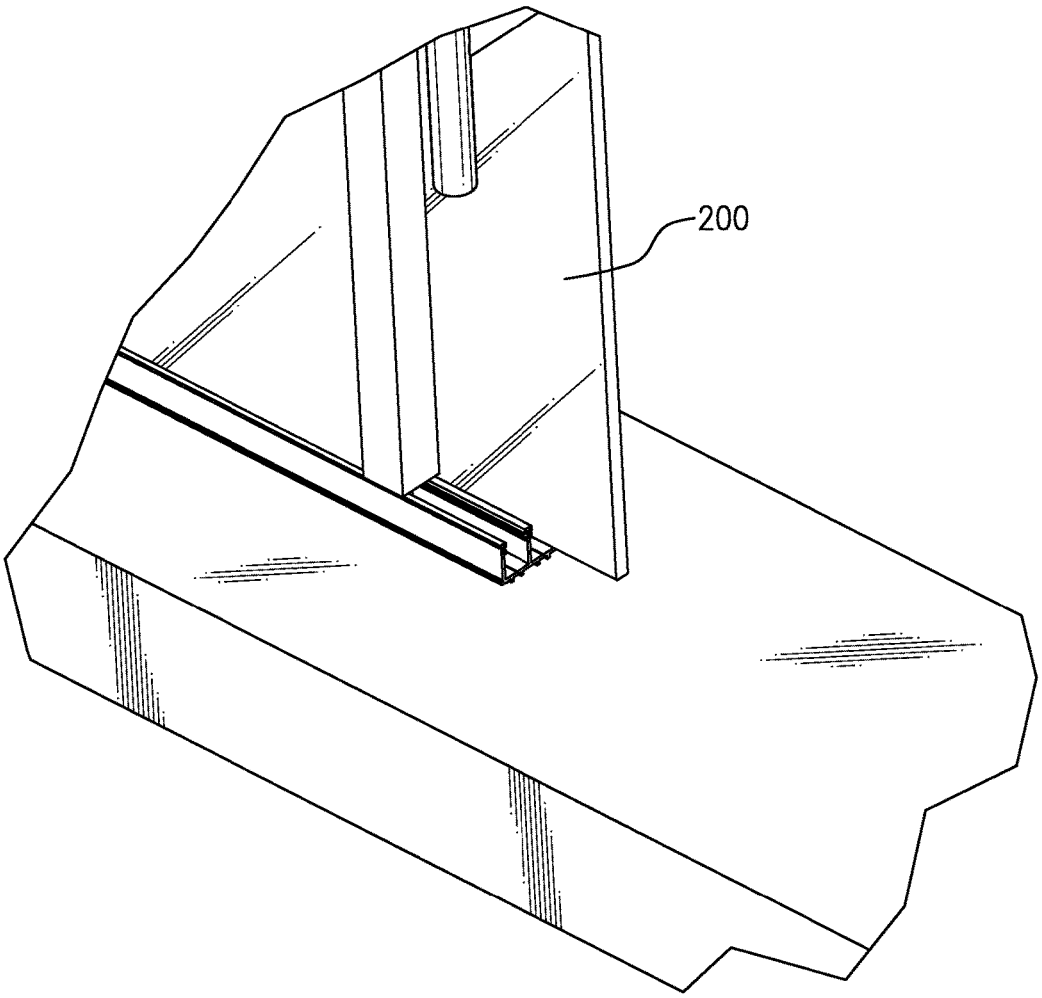
FIG. 18 shows a close-up perspective view of a portion of the pocket door assembly of FIG. 17.
Figure 19:
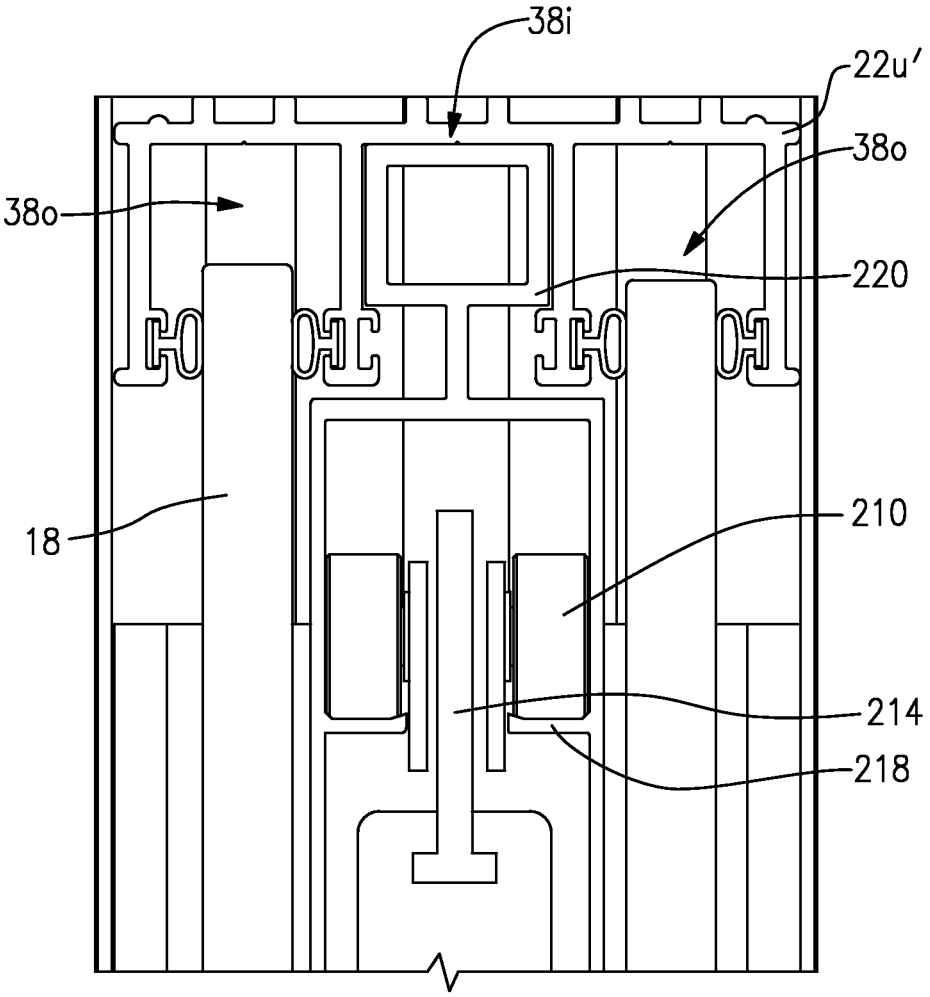
FIG. 19 shows a section view of an upper interface between the pocket door assembly of FIG. 17 and the frame structure of the demountable barrier system of FIG. 1.
Figure 20:
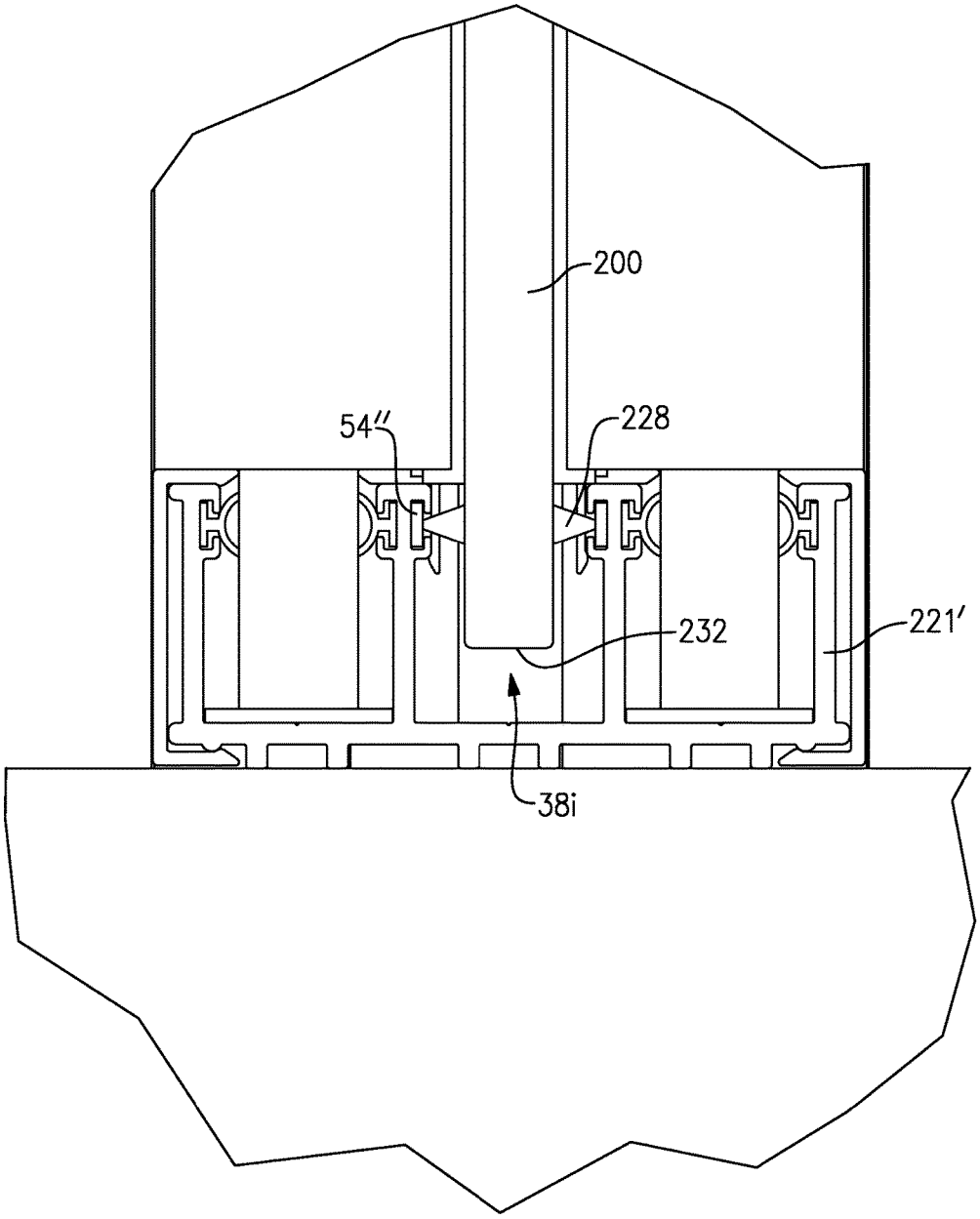
FIG. 20 shows a section view of a lower interface between the pocket door assembly of FIG. 17 and the frame structure of the demountable barrier system of FIG. 1.

Referring now to FIGS. 14-16, an example vertical member **26*a* is used to provide angled interfaces for two walls of the demountable barrier system 10. To construct the angled interface, a first vertical member 26' is fastened to a fixed planar surface 110 of the vertical member 26*a*. Mechanical fasteners may be utilized to secure the vertical member 26' to the fixed planar surface 110. A first wall of the demountable barrier system 10 is then built off of the vertical member 26'. The fixed planar surface 110** provides a "starter" for the first wall in this example.

An adjustable planar surface 112 is secured to a rounded portion 114 of the vertical member **26*a* at a desired circumferential position. The circumferential position of the adjustable planar surface 112 is based on the desired angle between the first wall and a second wall. A vertical member 26" is then secured to the adjustable planar surface 112. Mechanical fasteners may be utilized to secure the adjustable planar surface 100 to the rounded portion 114 and to secure the vertical member to the adjustable planar surface 100. The second wall of the demountable barrier system 10 is then built off of the vertical member 26". The adjustable planar surface 112** provides a "starter" for the second wall in this example.

Additional walls, such as a third wall, could also extend from the rounded portion 114 by using another adjustable planar surface.

The fixed planar surface 110 and the adjustable planar surface 112 may include grooves 116 to receive tabs 120 extending from the vertical members 26' 26". Receiving the tabs 120 within the grooves 116 helps to align the vertical member 26' to the fixed planar surface 110 and the vertical member 26" to the adjustable planar surface 112 during assembly. In other examples, the grooves are provided in one or both of the vertical members 26' and 26" and the corresponding adjustable planar surface 112 or fixed planar surface 110 includes the tabs.

Other vertical members 26 of the frame structure 14 may include similar tabs and groove structures to facilitate alignment during assembly. The grooves and tabs are designed such that when the tab is received within the groove, the members are properly aligned.

Referring again to FIGS. 9-13, many of members of the frame structure 14 are may be formed using similar processes, such as roll formed, and then cut to an appropriate length. For example, the horizontal member 221 and vertical member 26 shown in FIG. 9 may have been formed together as part of a continuous length. The horizontal member 221 and vertical member 26 are then cut to length. The members of the frame structure 14 are aluminum in this example, but could be made of other materials. The frame structure 14 can be anodized or painted.

The lower horizontal member 221 and vertical member 26 both include tabs 120. The vertical member 26 may rely on these tabs 120 for alignment to the adjustable planar surface 112 of FIG. 14, for example. The tabs 120 of the lower horizontal member 221 may engage a carpeted surface to help stabilize the frame structure 14. If the frame structure 14 is placed on a hardwood floor, pads may be placed between the tabs 120 of the lower horizontal member 221 and the floor to prevent damage.

When vertical members 26 are columnar, the tabs may fit with grooves areas on the column.

Referring now to FIGS. 17-20, a sliding or pocket door 200 may be used in connection with the frame structure 14 as part of the demountable barrier system 10. Barn door rollers 210 are attached to hangers 214 to support the pocket door 200. As the pocket door 200 is opened and closed, the barn door roller 210 rolls along flanges 218. The flanges 218 extend from a structure 220 that fits within the channel **38*i* of the associated upper horizontal member 22*u'***.

Notably, the pocket door 200 does not extend laterally past panels 18 received in outer channels **38*o* of the upper horizontal member 22*u'*. The pocket door 200 is thus considered to be within the plane of the associated demountable wall 224**.

Brush seals 228 may be held within the groove 54" of the channel **38*i* of the lower horizontal member 221' interfacing with the pocket door 200. The brush seals 228 help to align the pocket door 200 when moving between an open and closed position. A lowermost edge 232 of the pocket door 200 is spaced above a permanent floor 236** throughout its travel.

Figure 21:
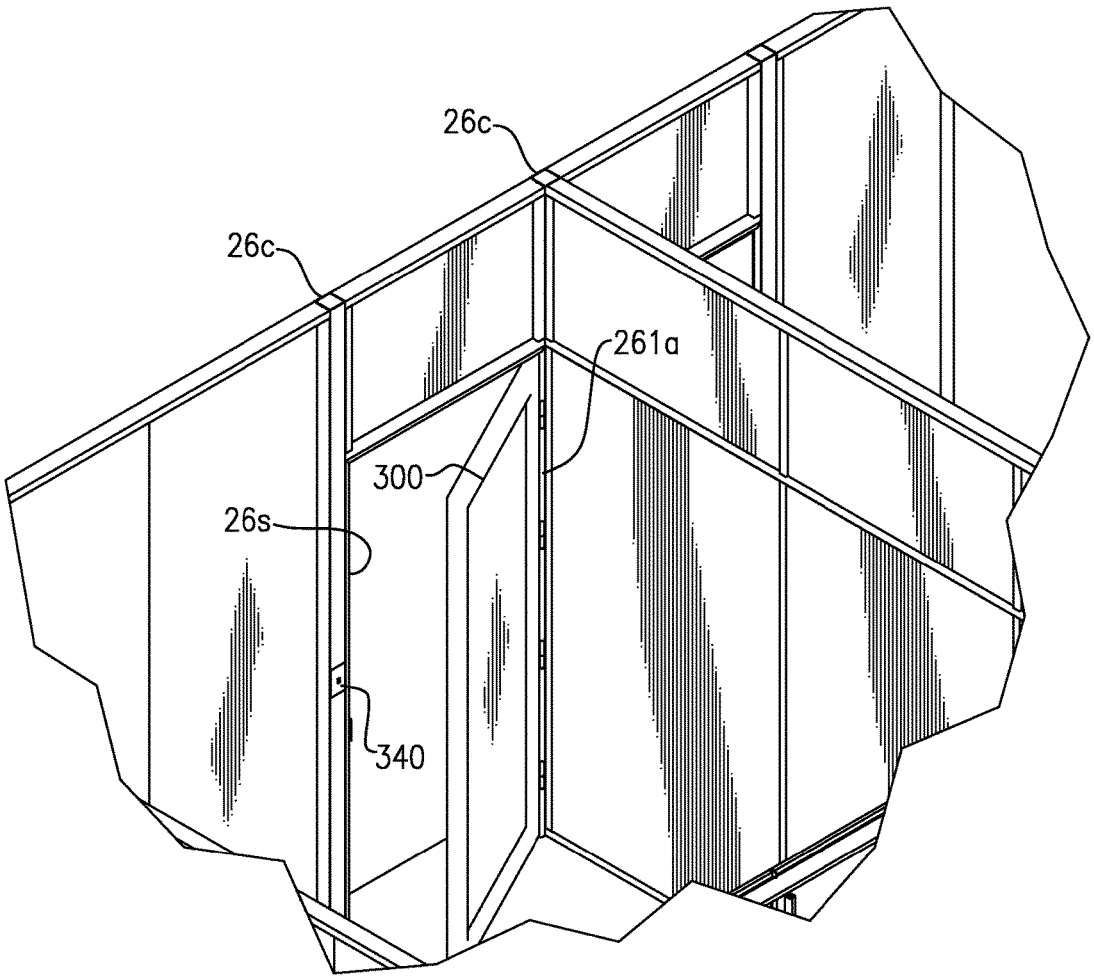
FIG. 21 shows a perspective view of a swinging door assembly for use in the demountable barrier system of FIG. 1.
Figure 22:
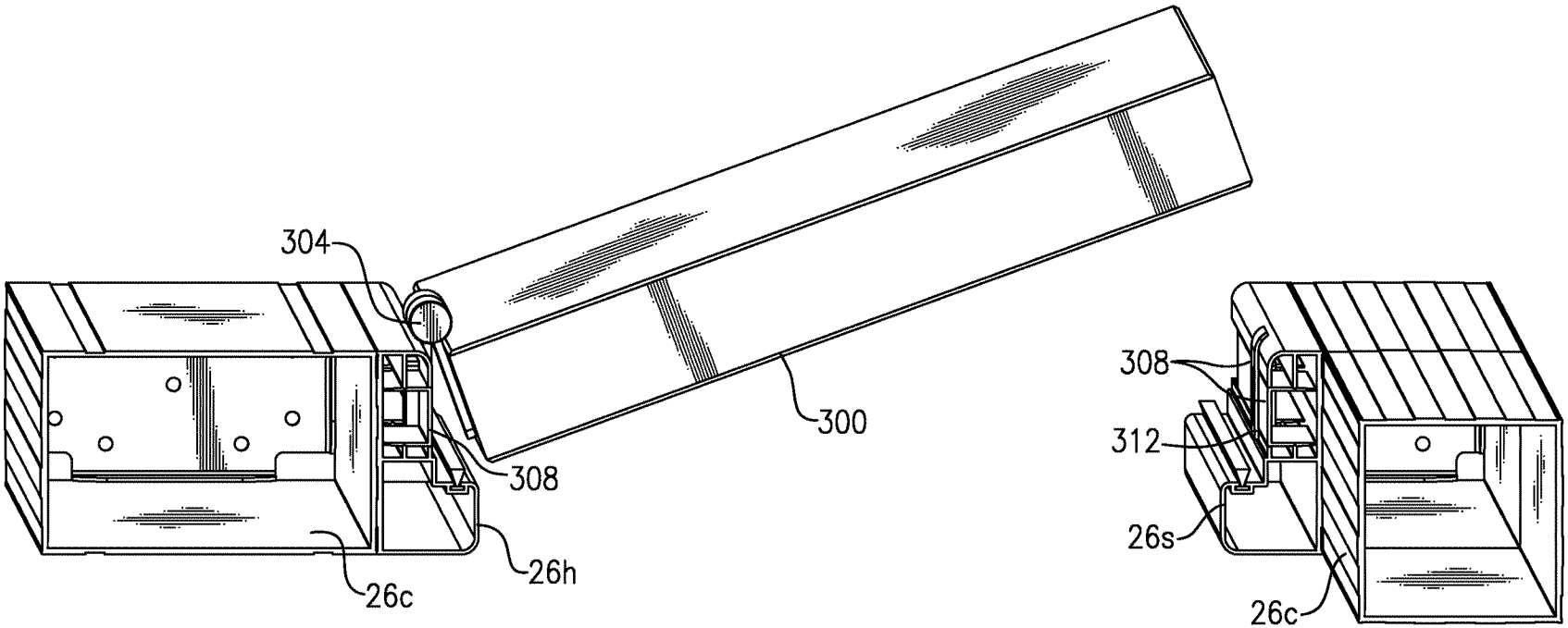
FIG. 22 shows another perspective view of the swinging door assembly of FIG. 21.

Referring now to FIGS. 21 and 22, a hinged door 300 also may be used within the demountable barrier system 10. A vertical member **26*h* is used to support a hinged side of the hinged door 300. Hinges 304 are fastened to the vertical member 26*h***.

A strike plate side of the hinged door 300 interfaces with a strike plate vertical member **26*s*. A strike plate 312 is secured to the strike plate vertical member 26*s* at a desired vertical height. Caps 308 may be used to conceal channels within the vertical members 26*h* and 26*s* in the areas of the channels that do not receive the hinge 304 or a strike plate 312**.

The strike plate vertical member **26*s* and the hinge vertical member 26*h* both are secured to columnar type vertical members 26*c*. The cross sections of the vertical members 26*c* are 3 inches by 5 inches in some examples. The vertical members 26*c* may provide a wire chase for outlets and switches, such as a switch 340**.

Figure 2:
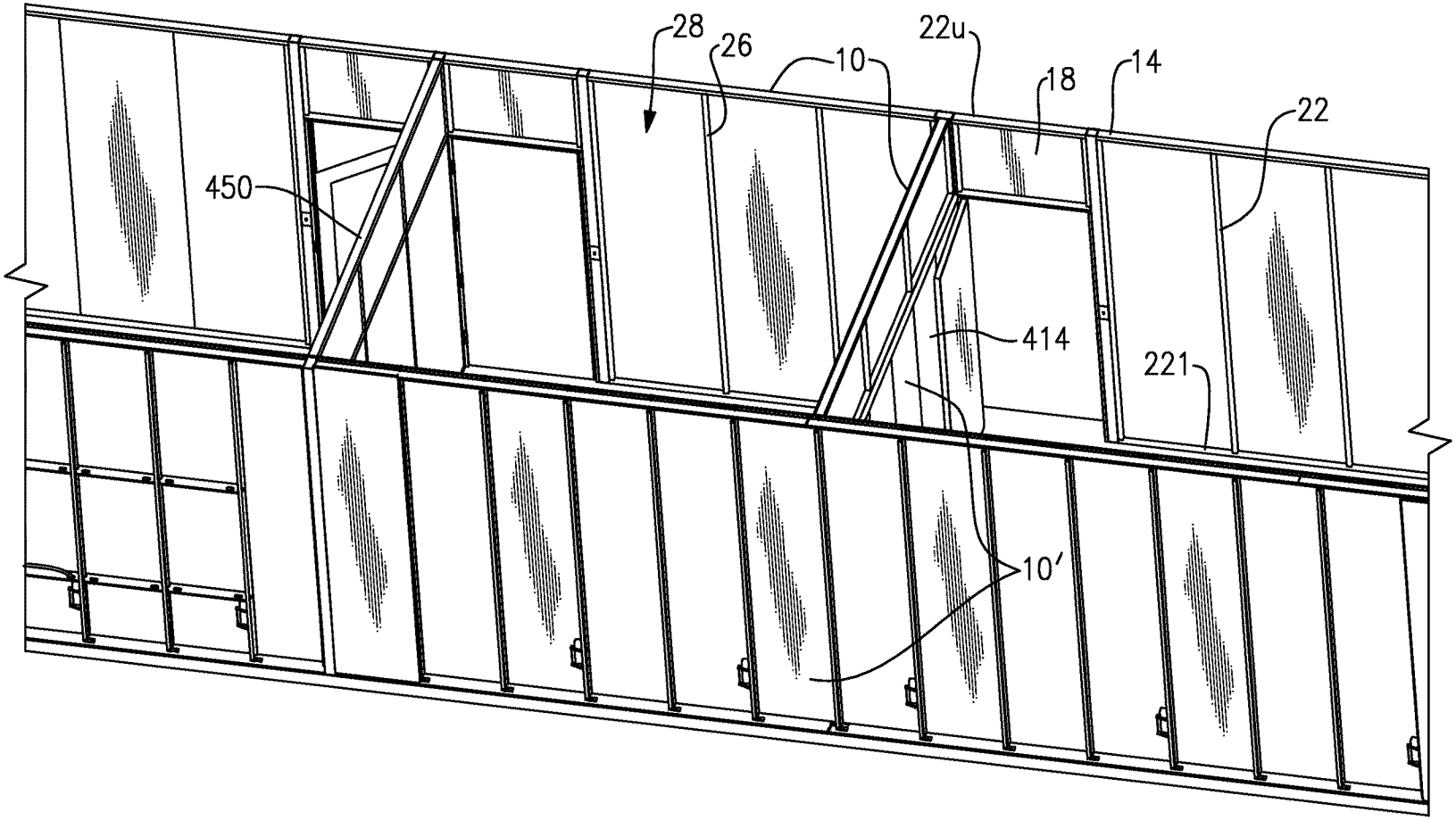
FIG. 2 shows another perspective view of the demountable barrier system of FIG. 1.
Figure 23:
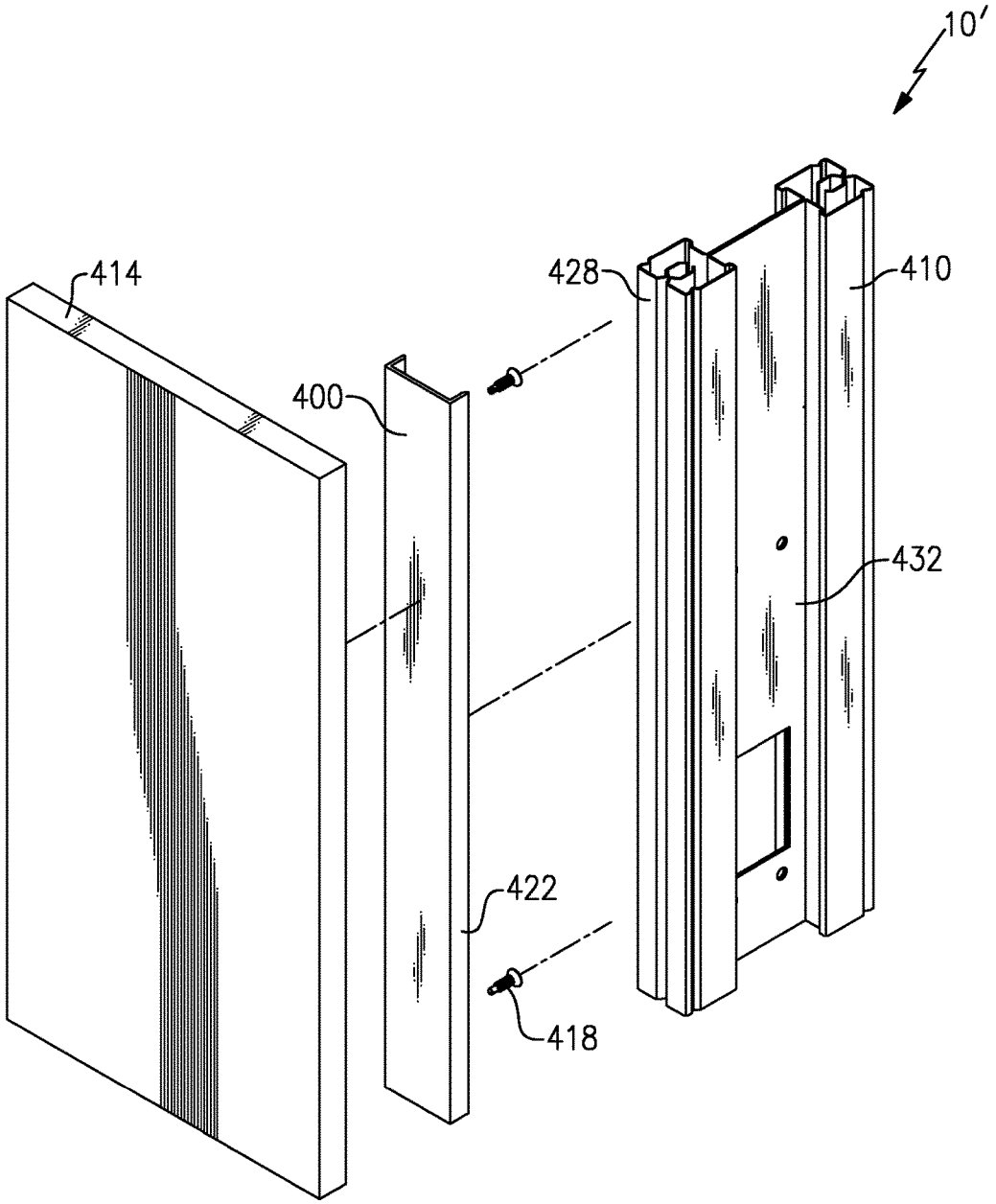
FIG. 23 shows an attachment assembly for securing another demountable barrier system to a relatively permanent wall structure.
Figure 24:
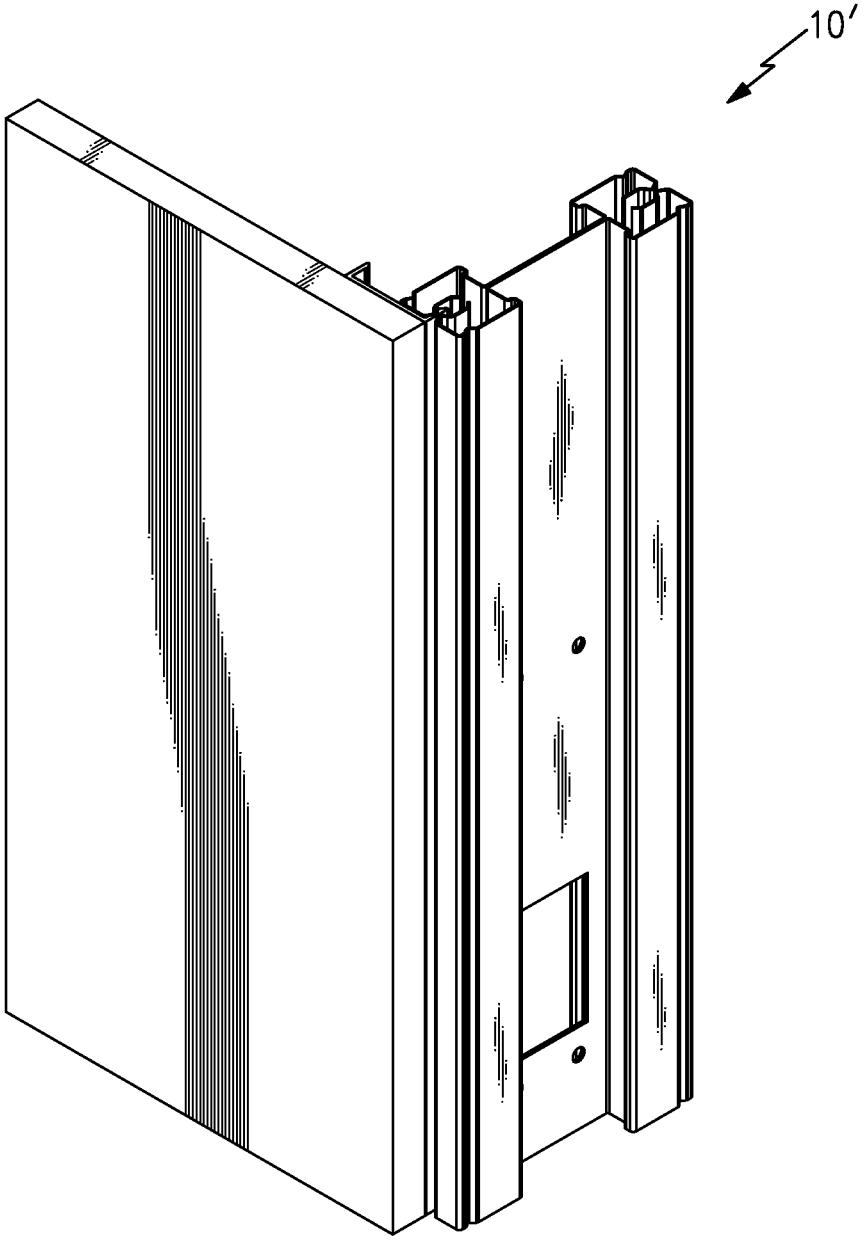
FIG. 24 shows another view of the attachment assembly of FIG. 23.

Referring now to FIGS. 23-24 with reference to FIGS. 1 and 2, the demountable barrier system 10' may be used in connection with the demountable barrier system 10. The demountable barrier system 10' includes C-shaped channels 400 secured to a first side of a panel 414 with mechanical fasteners 418. An opposing, second side of the panel 414 faces the interior space 28. Thus, the channel 400 and the mechanical fasteners 418 are not visible or exposed to the interior space 28. This feature may be particularly important in medical environments, clean rooms, etc.

An edge 422 of the channel 400 is received within a seam 428 of a vertical member 432. An interference fit between the edge 422 and the seam 428 stabilizes the vertical member 410 and the associated portions of demountable barrier system 10'.

The vertical members 432 of the demountable barrier system 10' are steel in some examples. The panels 414 may be gypsum board, for example. The vertical members 432 may be spaced two feet from each other in some examples. In other examples. The vertical members 432 are spaced four feet from each other.

Notably, as shown in FIGS. 1 and 2, the demountable barrier system 10' and the demountable barrier system 10 may form different portions of the same demountable wall 450.

Further, although shown as forming full walls, the demountable barrier system 10, the demountable barrier system 10', or both may be used to form a partial wall. For example, the demountable barrier system 10 may provide a knee wall outside a luxury suite at an arena. A drink tray could be fastened to the upper portion of the knee wall. The demountable barrier system 10 would facilitate reconfiguring the suite area.

Figure 25A:
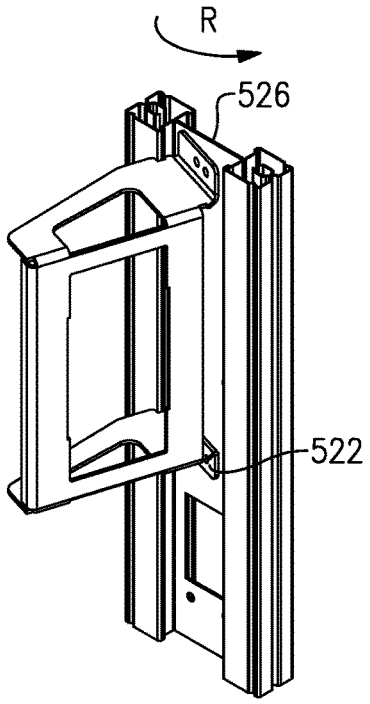
FIG. 25*a* shows an early stage of installing an outlet bracket used in connection with the demountable barrier system of FIG. 23.
Figure 25B:
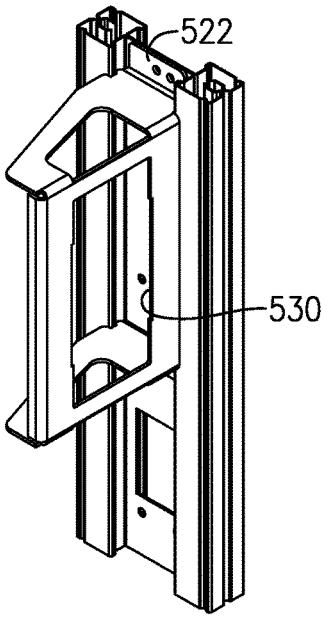
FIG. 25*b* shows a later stage of installing an outlet bracket used in connection with the demountable barrier system of FIG. 23.
Figure 25C:
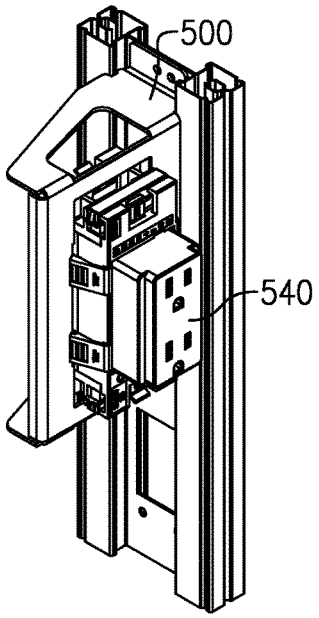
FIG. 25*c* shows an even later stage of installing an outlet bracket used in connection with the demountable barrier system of FIG. 23.

Referring now to FIGS. 25*a*-25*c*, an outlet bracket 500 may be used in connection with the demountable barrier system 10'. The outlet bracket 500 includes tabs 514 that are received behind corresponding tabs 518 of the vertical members 432 of the demountable barrier system 10'.

To install the outlet bracket 500, one of the tabs 514 is inserted behind one of the tabs 518. The outlet bracket 500 is then rotated in direction R until the other tab 514 snaps behind the tab 518 of the vertical member 410. Vertical adjustments of the outlet bracket 500 may then be made to position the outlet bracket 500 at a desired vertical height. Mechanical fasteners are then used to secure flanges 522 of the outlet bracket 500 to a central span 526 of the vertical member 432.

The outlet bracket defines an opening 530 that receives an outlet 540, such as a Tyco Brand outlet. The outlet bracket 500 provides vertical adjustment of the outlet 540 within the demountable barrier system 10'.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A demountable barrier system, comprising:

a first panel;

a second panel;

a frame structure having a first channel to receive the first panel, and a second channel to receive the second panel, the frame structure including a first member configured to secure directly to a ceiling of a building and a second member configured to secure directly to a floor of the building such that the frame structure extends from the ceiling to the floor, wherein the first member is a unitary member, and the second member is a unitary member;

a cap secured to the frame structure;

a first seal compressing against a first side of the first panel to hold the first panel, the seal slideably attached to the frame structure and the cap covering the first seal within the first channel; and a second seal compressing against an opposing, second side of the first panel to hold the first panel, the second seal slideably attached to the frame structure.

2. The demountable barrier system of claim 1, wherein the first seal comprises a bulb.

3. The demountable barrier system of claim 1, wherein all portions of the frame are spaced from the first panel and the second panel.

4. The demountable barrier system of claim 1, wherein no portion of the frame contacts the first panel or the second panel.

5. The demountable barrier system of claim 1, further comprising a setting block that is slideably received within the first channel, the setting block supporting the first panel vertically.

6. The demountable barrier system of claim 1, wherein the frame structure extends circumferentially about the first panel, and the channel is circumferentially continuous about the first panel.

7. The demountable barrier system of claim 1, further comprising a clip for securing a first member of the frame structure to a second member of the frame structure, the clip including a first tab received within one of the at least two channels and a second tab received within another of the at least two channels.

8. The demountable barrier system of claim 7, wherein the clip includes a first finger secured to a first side of one of the at least two channels and a second finger secured to a second side of the another one of the at least two channels, the first side and the second side facing in opposite directions.

9. The demountable barrier system of claim 1, wherein the cap is snap-fit to the frame structure.

10. The demountable barrier system of claim 1, wherein the frame structure is a first frame structure secured to a fixed surface of an angled interface member, and a second frame structure is secured to an adjustable surface that is secured to a rounded portion of the angled interface member, wherein the first frame structure at least partially supports the first panel and the second panel to provide a first wall, and the second frame structure at least partially supports another panel to provide a second wall that is angled relative to the first wall.

11. The demountable barrier system of claim 10, further comprising a keying feature that aligns the adjustable surface relative to the rounded portion when the adjustable surface is secured to the rounded portion.

12. The demountable barrier system of claim 11, wherein the keying feature comprises a groove in one of the adjustable surface or the rounded portion, and a tab in the other one of adjustable surface or the rounded portion.

13. The demountable barrier system of claim 11, further comprising another keying feature that aligns the first frame structure to the fixed surface when the first frame structure is secured to the fixed surface.

14. The demountable barrier system of claim 1, wherein at least one of the first panel or the second panel is opaque.

15. The demountable barrier system of claim 1, wherein at least a portion of the first seal is received within a groove provided by the frame structure to secure the first seal to the frame structure.

16. The demountable barrier system of claim 1, wherein the first and second panels are panels of a demountable wall.

17. The demountable barrier system of claim 1, wherein the first and second panels are panels of a nonfixed construction building system.

18. The demountable barrier system of claim 1, wherein the frame structure is a nonpivoting frame structure.

19. The demountable barrier system of claim 1, wherein the first member is aluminum, and the second member is aluminum.

20. A method of installing a panel of a demountable wall, comprising:

inserting a first panel into a first channel of a frame structure;

holding the first panel using a first seal that is slideably secured to the first channel covering the first seal with a cap to contain the first seal within the first channel;

inserting a second panel into a second channel of the frame structure;

compressing the first seal against a first side of the first panel during the holding; and compressing a second seal against an opposite, second side of the first panel during the holding, wherein the frame structure includes a unitary first member configured to secure directly to a ceiling of a building and a unitary second member configured to secure directly to a floor of the building such that the frame structure extends from the ceiling to the floor.

21. The method of claim 20, further comprising covering the first seal within channel with a cover that is removeably attached to the frame structure.

22. The method of claim 20, wherein no portion of the frame structure contacts the first panel during the holding.

23. The method of claim 20, wherein at least one of the first panel or the second panel is opaque.

24. The method of claim 20, wherein the frame structure is a nonpivotable frame structure.

25. The method of claim 20, wherein the unitary first member and the unitary second member are aluminum.

26. A demountable barrier system, comprising:

a first panel;

a second panel;

a frame structure having a first channel to receive the first panel, and a second channel to receive the second panel, the frame structure including an aluminum first member configured to secure directly to a ceiling of a building and an aluminum second member configured to secure directly to a floor of the building such that the frame structure extends from the ceiling to the floor;

a cap secured to the frame structure;

a first seal compressing against a first side of the first panel to hold the first panel, the seal slideably attached to the frame structure and the cap covering the first seal within the first channel; and a second seal compressing against an opposing, second side of the first panel to hold the first panel, the second seal slideably attached to the frame structure.

* * * * *